US006422140B1

(12) United States Patent
Lookholder et al.

(10) Patent No.: US 6,422,140 B1
(45) Date of Patent: Jul. 23, 2002

(54) STAMPING DEVICE

(75) Inventors: Dale Lookholder, Santa Clarita; Christopher B. Caston, Glendale; Joaquin G. Serrano; Theodore Lookholder, both of Los Angeles, all of CA (US)

(73) Assignee: Glendale Rubber Stamp & Printing Co., Glendale, CA (US)

( * ) Notice: Subject to any disclaimer, the term of this patent is extended or adjusted under 35 U.S.C. 154(b) by 0 days.

(21) Appl. No.: 09/556,926

(22) Filed: Apr. 21, 2000

Related U.S. Application Data

(63) Continuation-in-part of application No. 09/353,115, filed on Jul. 14, 1999, now Pat. No. 6,095,046.

(51) Int. Cl.[7] ..... B41M 1/12
(52) U.S. Cl. ..... 101/129; 101/483
(58) Field of Search ..... 101/129, 128, 101/128.1, 128.4, 483, 487

(56) References Cited

U.S. PATENT DOCUMENTS 2,241,380 A * 5/1941 Gfeller ..... 101/127
3,862,875 A * 1/1975 Uchytil ..... 161/38
4,424,089 A * 1/1984 Sullivan ..... 101/129
5,776,661 A * 7/1998 Casaletto et al. ..... 430/306
5,845,575 A * 12/1998 Eda et al. ..... 101/483
6,030,743 A * 2/2000 Okumura et al. ..... 430/203
6,270,611 B1 * 8/2001 Ohki et al. ..... 156/220

* cited by examiner

*Primary Examiner*—Andrew H. Hirshfeld
*Assistant Examiner*—Anthony H. Nguyen
(74) *Attorney, Agent, or Firm*—James E. Brunton

(57) ABSTRACT

A hand-held stamping device and the method of making same that includes a substantially transparent acrylic mounting block to which a substantially transparent printing element is removably affixed without the use of adhesives. When the device of the invention is used, the indicia formed on the printing element can be clearly viewed through the mounting block, and the printing surface can be clearly viewed through the printing element. This enables precise positioning of the indicia on the surface to be printed. The device includes both a convex surface and a planar surface to which the printing element can be removably affixed. When the printing element is affixed to the planar surface, the indicia on the printing element, when viewed through the convex surface, is magnified.

7 Claims, 19 Drawing Sheets

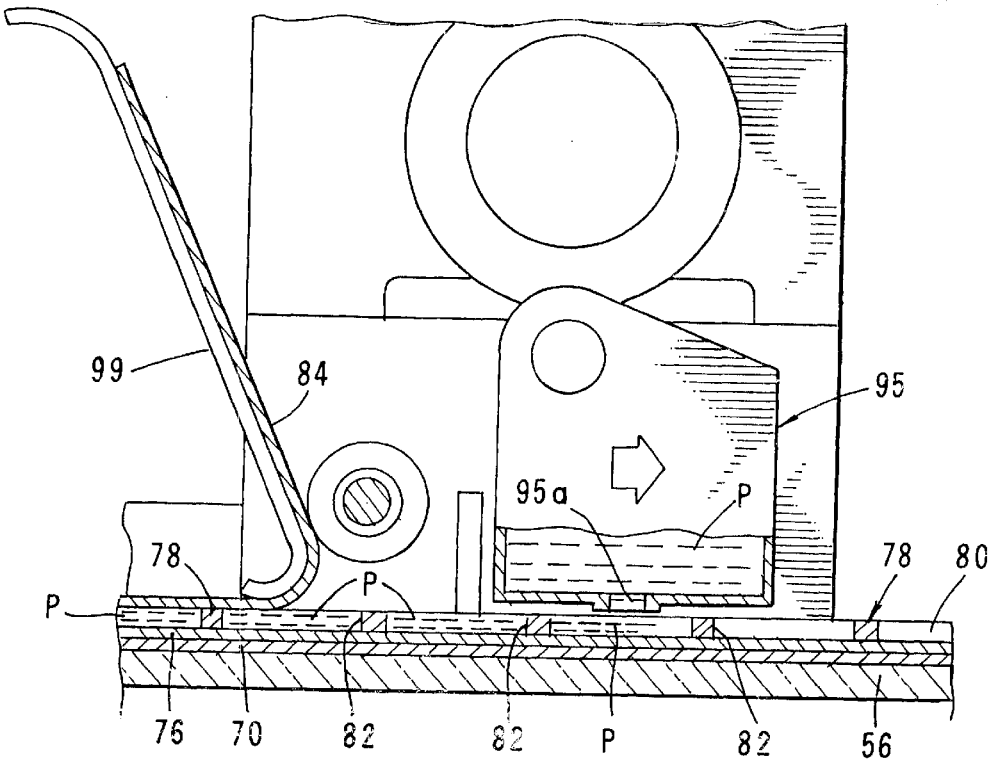
FIG. 15
FIG. 14A
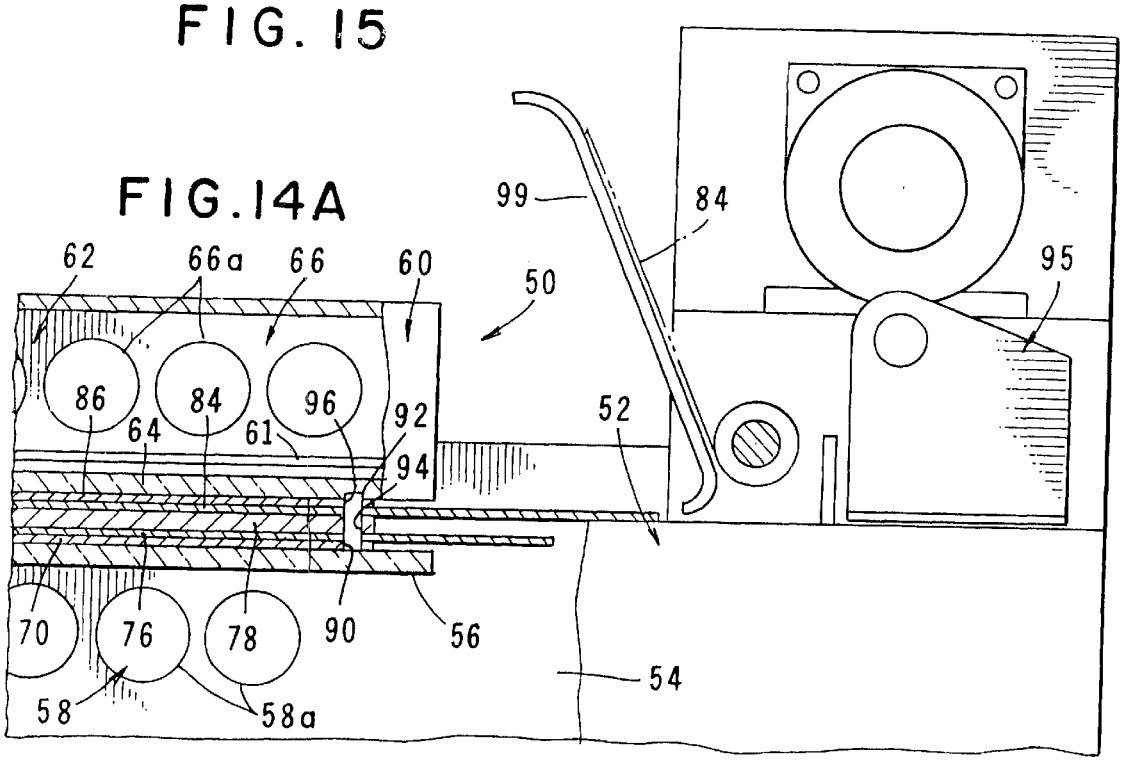

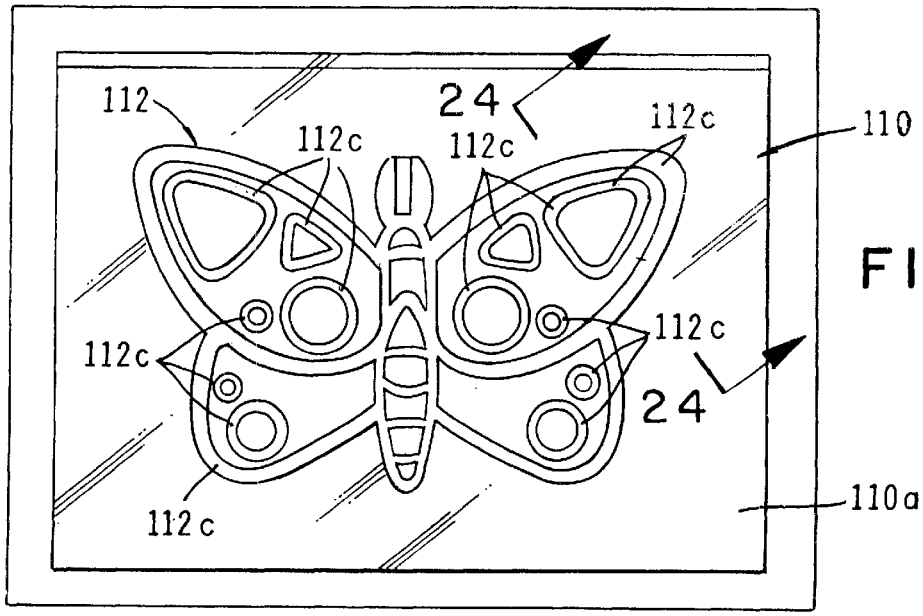
FIG. 23
FIG. 24
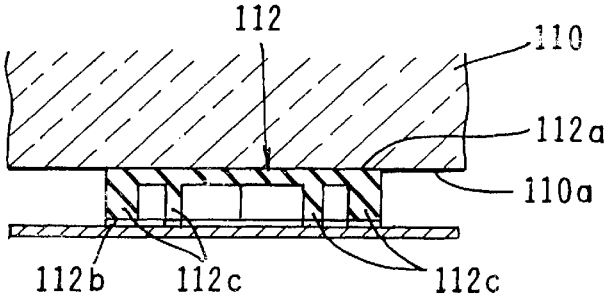
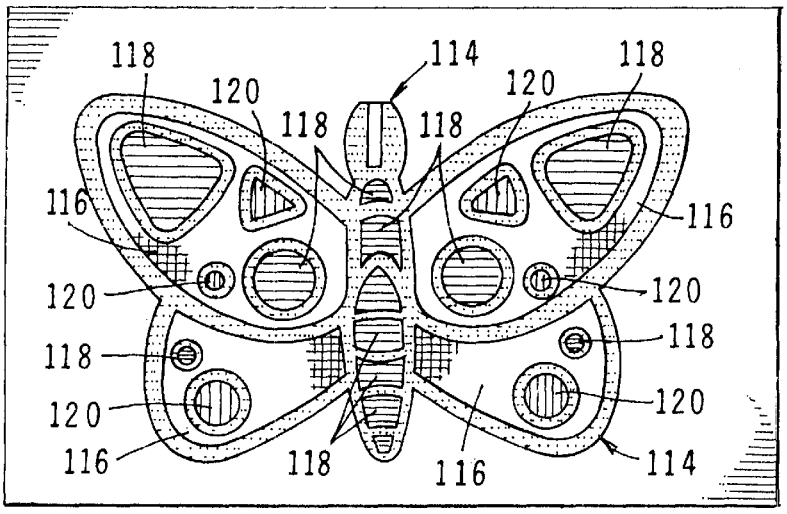
FIG. 25

STAMPING DEVICE

This is a Continuation-In-Part Application of U.S. Ser. No. 09/353,115 filed Jul. 14, 1999 now U.S. Pat. No. 6,095,046.

BACKGROUND OF THE INVENTION

FIELD OF THE INVENTION

The present invention relates generally to hand stamping devices and the method of making same. More particularly, the invention concerns a novel hand stamping apparatus having a substantially transparent, hand-held mounting block to which a substantially transparent printing element or die can be removably affixed without the use of adhesives. In using the device the printing element can be clearly viewed through the transparent mounting block and the surface to be imprinted can be viewed through the printing element so that the indicia formed on the printing element can be precisely positioned relative to the surface to be imprinted.

DISCUSSION OF THE INVENTION

Hand stamp devices of many different configurations have been suggested in the past. The classic hand stamp comprises a rubber stamp die that is fixedly mounted on a wooden block to which a bulb shaped wooden handle is attached. Such hand stamps are traditionally used with an ink pad which applies ink to the indicia formed on the die prior to each stamping operation. The printing element or pattern bearing surface is typically made of rubber.

In recent years a number of different types of hand stamps having elaborate pattern-bearing, ink-receiving surfaces have been suggested. These types of hand stamps may be used to print a wide variety of decorative images on envelopes, stationery and the like. However, because the pattern-bearing surface cannot be seen through the stamp supporting block or handle it is virtually impossible to precisely position the pattern on the surface to be imprinted. Similarly, prior art hand stamp devices having indicia in the form of legends such as words and numbers are difficult to use because the user cannot see the indicia and therefore cannot accurately position it on the surface to be imprinted.

The prior are ink stamp device disclosed in U.S. Pat. No. 5,642,667 issued to Sastre partially solves the stamp positioning problem discussed in the preceding paragraphs by providing a translucent handle and base through which the imprinting element is visible. However, because the imprinting element itself is not transparent, precise positioning of the indicia on the imprinting element remains difficult.

U.S. Pat. No. 3,973,495 issued to Rowe also discloses a hand stamp comprising a transparent base through which a proof of the impression is visible to the user. However, like the Sastre device, the printing element itself is not transparent.

The thrust of the present invention is to provide an improved hand-held ink stamp in which both the mounting block and the imprinting element that is removably affixed thereto without the use of adhesives are substantially transparent so that the indicia formed on the imprinting element can be seen clearly and precisely positioned on the surface to be imprinted.

Additionally, in one for of the present invention, the mounting block is uniquely formed so as to magnify the indicia formed on the imprinting element when viewed through the convex tipper surface of the mounting block.

SUMMARY OF THE INVENTION

It is an object of the present invention to provide a novel hand stamp and method of making the same which is of an elegantly simple construction that includes a substantially transparent acrylic mounting block to which a substantially transparent printing element is removably affixed without the use of adhesives. With this construction, when the device is used, the indicia formed on the printing element can be clearly viewed through the mounting block, and the printing surface can be clearly viewed through the printing element.

Another object of the invention is to provide a hand stamp of the aforementioned character in which the sides of the mounting block are provided with finger gripping means so that the stamp can be conveniently gripped by the user.

Another object of the invention is to provide a hand stamp of the character described in the preceding paragraphs in which the mounting block includes a convex upper surface which magnifies the indicia formed on the printing element when the printing element is affixed to the lower planar surface of the mounting block.

Another object of the invention is to provide a hand stamp of the type described in the preceding paragraphs in which the substantially transparent printing element is formed from a photopolymer and is resiliently deformable so that it can be selectively removably affixed to either the convex surface or the planar surface of the mounting block.

Another object of the invention is to provide a hand stamp of the class described in which a plurality of substantially transparent individual printing elements can be removably affixed to either of the surfaces of the mounting block.

Another object of the invention is to provide a hand stamp of the character described in the preceding paragraphs in which the stamping element is bounded by an upstanding edge portion to which ink can be applied from an ink pad or the like.

Another object of the invention is to provide a method for making hand stamps of the character described in which the die or stamping element is constructed in a novel manner from a substantially transparent photo polymer.

Another object of the invention is to provide a method as described in the preceding paragraph in which the die or stamping element is uniquely formed to exhibit a novel adhering surface that will permit the die to be removably affixed to a smooth surface without the need for conventional adhesives.

BRIEF DESCRIPTION OF THE DRAWINGS

FIG. 14 and 14A when considered together comprise a side-elevational view partly in cross section of the components shown in FIG. 13 stacked within the exposure unit shown in FIG. 12.

FIG. 15 is a fragmentary, cross-sectional view similar to 14A illustrating the deposition step wherein the photopolymer is deposited onto the stacked array shown in FIGS. 14 and 14A.

FIG. 23 is an enlarged, bottom plan view illustrating the printing element shown in FIG. 22 affixed to the mounting block for use in producing a first image on the printing surface.

FIG. 24 is an enlarged, cross-sectional view taken along lines 24—24 of FIG. 23.

FIG. 25 is a plan view of the image produced on the printing surface by the apparatus shown in FIGS. 23 and 24.

DESCRIPTION OF THE INVENTION

Figure 1:
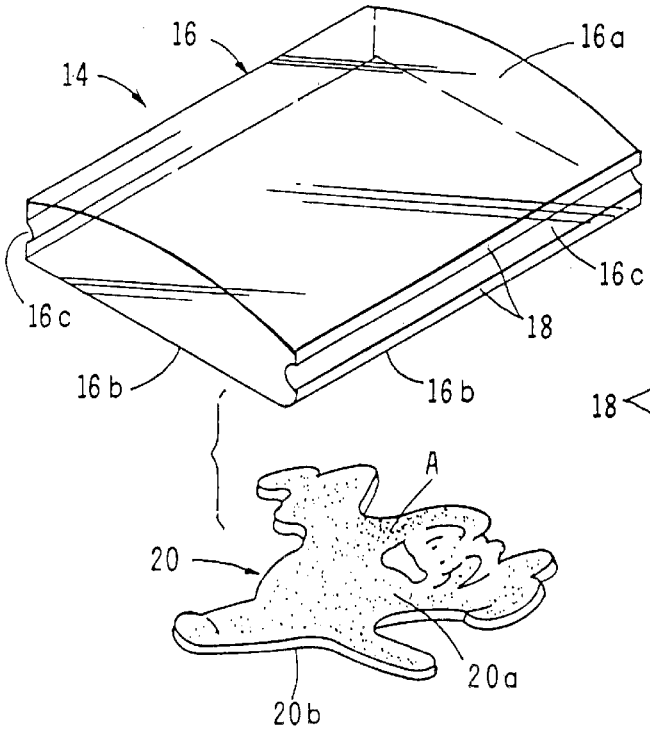
FIG. 1 is a generally perspective, exploded top view of one form of the hand stamp device of the invention.
Figure 2:
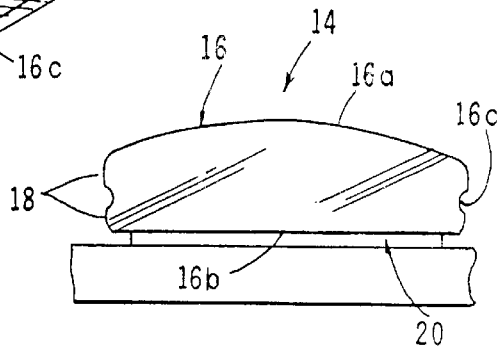
FIG. 2 is an end view of the device illustrated FIG. 1 and shown in engagement with the surface to be imprinted.
Figure 3:
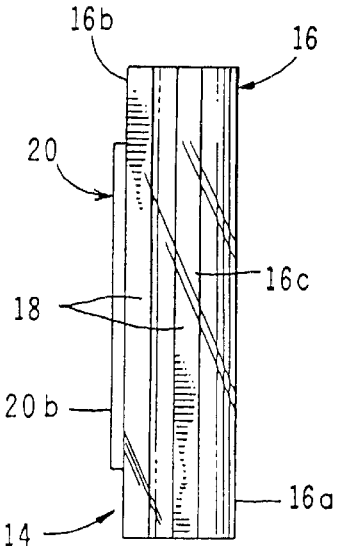
FIG. 3 is a side view of the device shown in FIG. 1.

Referring to the drawings and particularly FIGS. 1 through 3, one form of the stamping device of the invention is there illustrated and generally designated by the numeral 14. The device here comprises a substantially transparent, rigid, plastic mounting block 16 having a mirror polished, convex top surface 16*a*, a generally planar, mirror polished bottom surface 16*b*, and spaced-apart sides 16*c*. As best seen in FIGS. 1 and 2 each of the spaced-apart sides 16*c* is provided with gripping means shown here as finger gripping portions 18. Mounting block 16 can be formed of various plastics but a clear acrylic has proven satisfactory.

Figure 7:
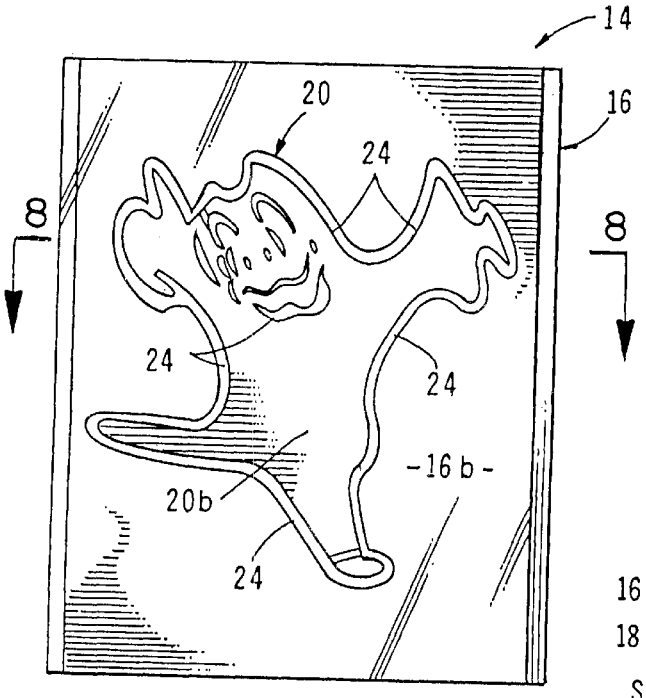
FIG. 7 is an enlarged bottom plan view of the form of the device shown in FIG. 1.
Figure 9:
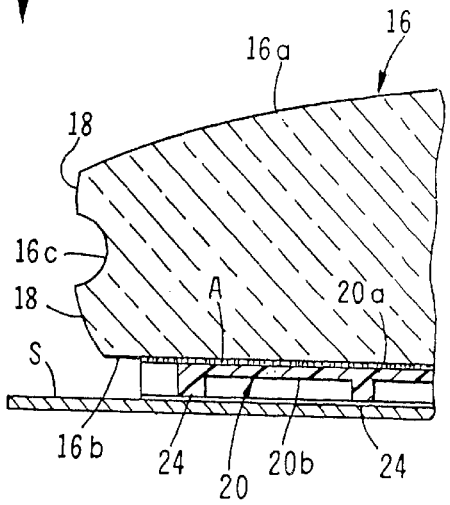
FIG. 9 is a greatly enlarged cross-sectional view of the area designated in FIG. 8 by the numeral 9.
Figure 8:
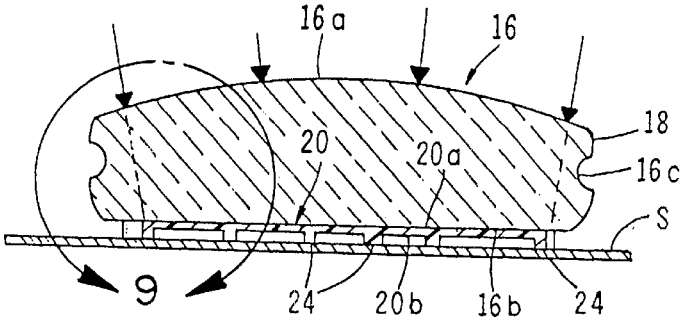
FIG. 8 is a cross-sectional view taken along lines 8—8 of FIG. 7.

In the form of the invention shown in FIGS. 1, 2, and 3, a substantially transparent imprinting element or die 20 is removably affixed to bottom surface 16*b* in the manner indicated in FIGS. 2 and 3. Imprinting element 20 is preferably formed of a photopolymer such as a liquid polyester that will polymerize when exposed to ultraviolet light. Element 20 is resiliently deformable and includes a generally planar, adhesive coated first side 20*a* and a spaced-apart second surface 20*b* (FIG. 1). As best seen by referring to FIGS. 8 and 9, second surface 20*b* is provided with upstanding ink receiving portions 24, which portions define the details of the stamped impression. As best seen by referring to FIG. 7, portions of the upstanding ink receiving portions, or ribs 24, circumscribe the periphery of the printing element and define the outer limits of the indicia that will be imprinted on the surface "S" which receives the inked impression (FIG. 9). Portions 24 can be inked using conventional ink pads containing conventional inks or water soluble inks. When water soluble inks are used, the ink will readily evaporate returning the printing element to its transparent condition.

Figure 10:
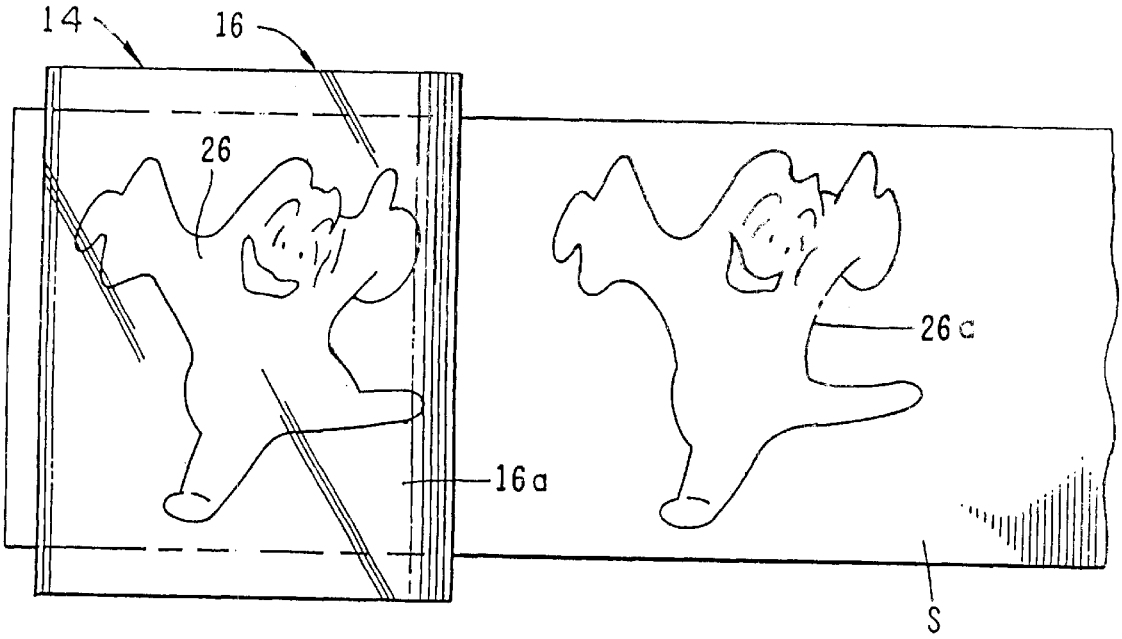
FIG. 10 is a generally diagrammatic view illustrating the magnifying capability of the device.

As depicted in FIG. 10, when an imprinting element, such as element 26, is affixed to the bottom surface 16*b* of the mounting block 16, the convex upper surface 16*a* of the mounting block 16 functions to magnify the image 26*a* which is imprinted on the imprinted surface "S". More particularly, as shown in FIG. 10, when the imprinted indicia, generally designated in FIG. 10 by the numeral 26, is viewed through the mounting block 16 as indicated in the left-hand portion of FIG. 10, the image to be imprinted will be somewhat magnified, that is larger in size than indicia 26*a*, to enable better viewing of the details of the stamped indicia. when the stamping element includes highly detailed decorative features, this aspect of the invention is very useful.

Figure 4:
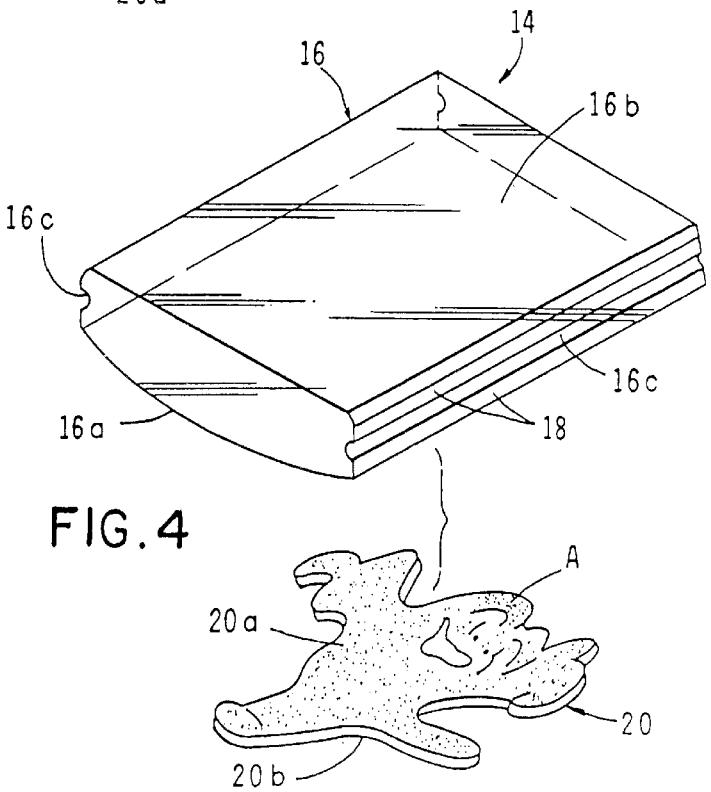
FIG. 4 is a generally perspective, exploded bottom view of the device of the invention showing the printing element removably affixed to the convex surface of the mounting block.
Figure 5:
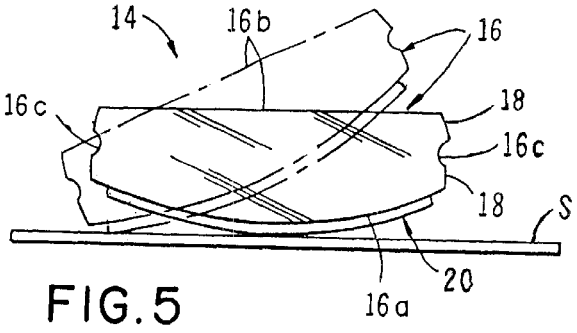
FIG. 5 is an end view of the device shown in FIG. 4 illustrating the manner of its use to imprint indicia onto a printing surface by means of a rocking motion.
Figure 6:
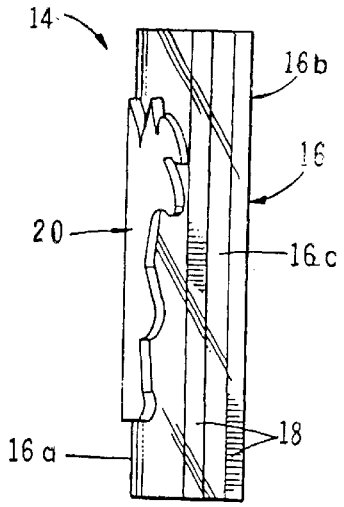
FIG. 6 is a side view of the device illustrated in FIGS. 4 and 5.

Turning next to FIGS. 4, 5 and 6, another highly novel feature of the present invention is there illustrated. More particularly, as illustrated in these FIG. drawings, the transparent imprinting element 20 can also be affixed to the convex upper surface 16*a* of the block so that the image can be imprinted onto the surface "S" by a rolling or rocking motion imparted to the mounting block in the manner illustrated in FIG. 5. Because of the resilient nature of the imprinting element 20, the element will smoothly conform to the convex surface 16*a* so as to produce a clear image such as image 26*a* on the printed surface "S".

Figure 11:
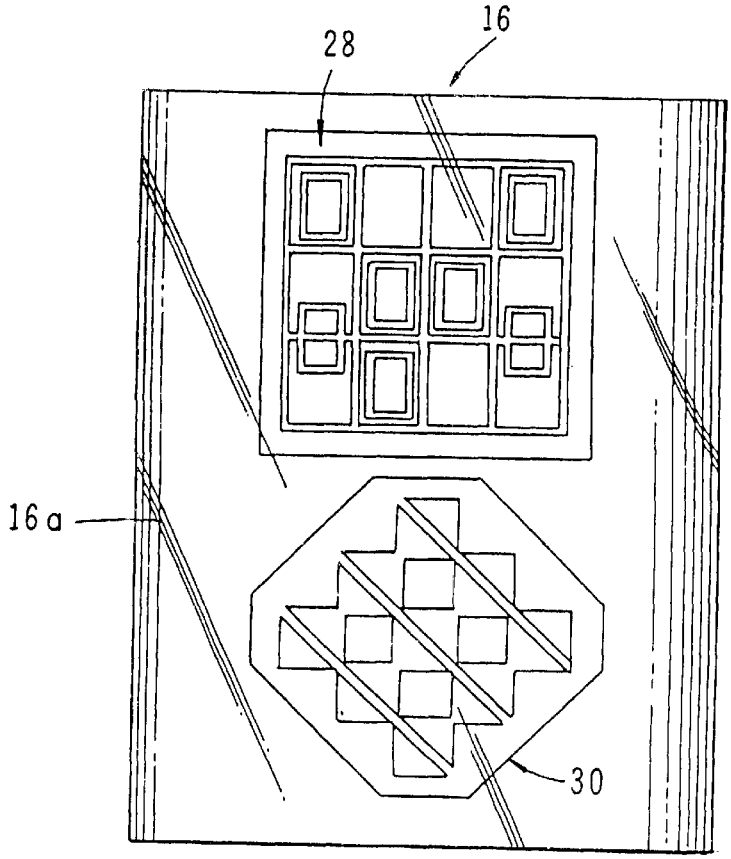
FIG. 11 is a plan view of an alternate form of the stamping device showing a plurality of dies affixed to the mounting block.

Referring next to FIG. 11, it is to be observed that a plurality of highly detailed imprinting elements, such as elements 28 and 30, can be removably affixed to either surface 16*a* or 16*b* of mounting block 16. As previously discussed, when the imprinting elements are removably affixed to generally planar surface 16*b*, the indicia provided on the imprinting elements will be magnified when viewed through the mounting block in the direction of the arrows of FIG. 7. Because the mounting block is substantially transparent as are each of the imprinting elements 20, 28, and 30, it is at once apparent that the images to be formed on the imprinted surface "S" can be clearly viewed and precisely located and arranged on the surface "S" with great ease. When the imprinting elements comprise legends such as numbers and letters, the ability to view the precise location of the legends on each of the stamps is extremely important and, for example, enables the legends to be precisely positioned over a line or between lines provided on the surface "S". Additionally, when intricate designs are formed on the imprinting element, such as those illustrated in FIG. 11, the precise location of the details of each image can be precisely positioned on the surface "S".

Figure 14:
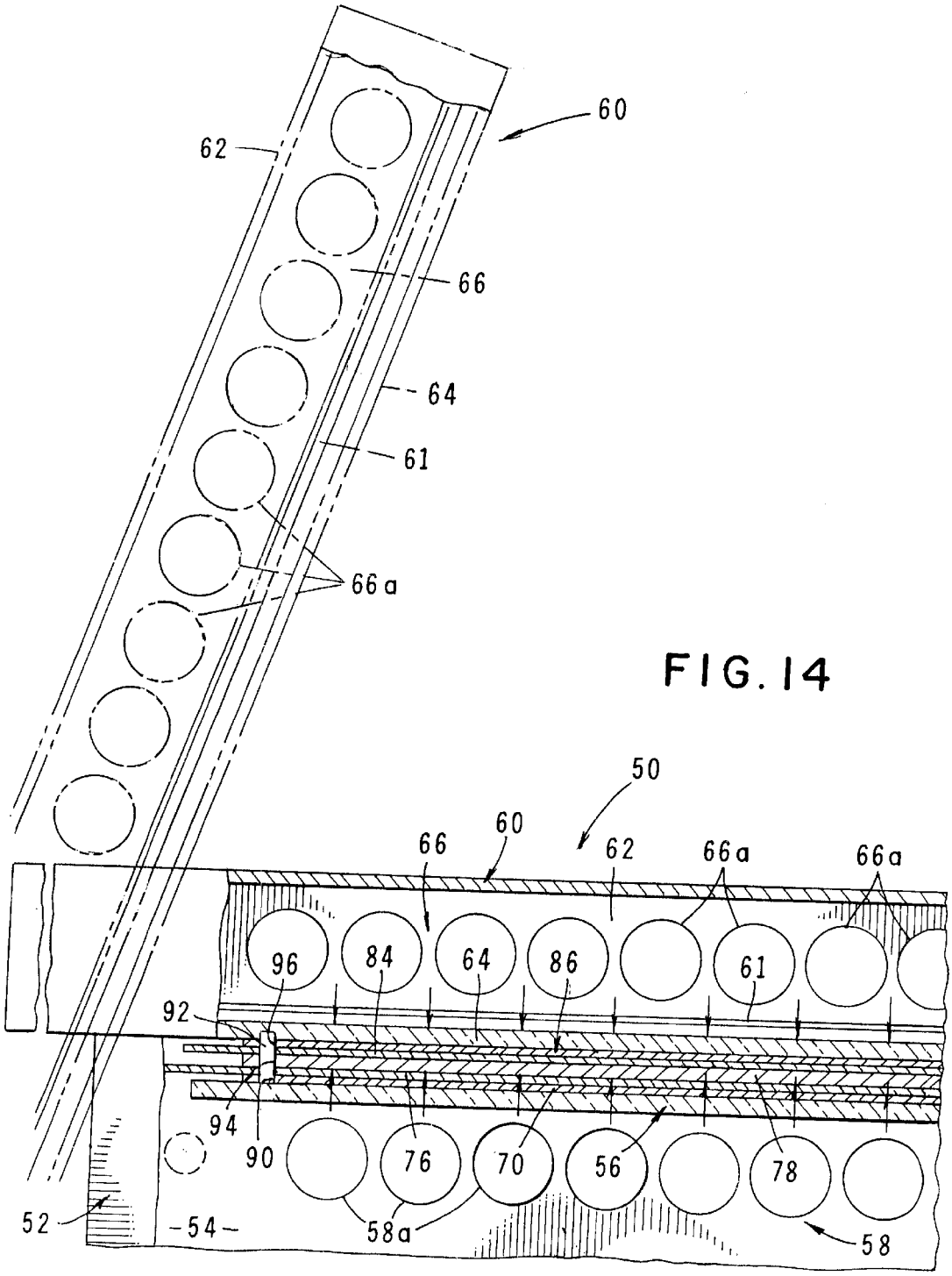

While the imprinting elements 20, 28 and 30 can be constructed of various materials, the aforementioned photopolymer material is preferred. Such material is readily commercially available from several sources such as The Louis Melind Company, Inc. of Skokie, Ill. and the printing elements themselves can be formed by ultraviolet curing in a manner well understood by those skilled in the art. Additionally, a suitable adhesive "A" (FIG. 1) can be applied to surface 20*a* in a manner well understood by those skilled in the art. Alternatively, the printing element can be constructed from a suitable polymer that exhibits viscoelastic characteristics that enables the printing element to be removably affixed to either the convex or planar surfaces of the mounting block without the use of an adhesive "A". These viscoelastic polymers in effect exhibit a multiplicity of very small struction-cup like protuberances which releasably grip the smooth surfaces of the mounting block Referring now to FIG. 12, one form of the apparatus for carrying out the method of the invention is there shown and generally designated by the numeral 50. Apparatus 50, which is readily commercially available from various sources including the MacDermid Company of Wilmington, DE, comprises a housing 52 which includes an internal chamber 54 (FIG. 14). The top opening and of chamber 54 is closed by a glass panel 56. Disposed within chamber 54 and located directly below glass panel 56 is a first bay of lamps 58 comprising a plurality of ultraviolet lamps 58*a*, the purpose of which will presently be described. Hingedly connected to housing 52 is a cover assembly 60 which includes an internal chamber 62 that is, covered by a glass panel 64 (FIG. 14). Disposed within chamber 62 is a second bay of lamps 66 comprising plurality of ultraviolet lamps 66*a*.

When cover assembly 60 is moved in from the position shown by the phantom lines in FIG. 14 to the position shown by the solid lines in FIG. 14 , a glass panel 64 is moved into close proximity with glass panel 56. For reasons presently to be described, cover assembly 60 further includes an opaque screen 61 (FIG. 14) that can be moved from a retracted position to an expanded position wherein it covers glass panel 64 and prevents radiation from ultraviolet lamps 66*a* from passing there through. Also forming a part have apparatus 50 is a deposition means for controllably depositing onto a grid element the liquid photopolymer "P" used to form of the die or printing element of the hand stamp of the invention. The construction and operation of this deposition means will be described in the paragraphs that follow.

Figure 13:
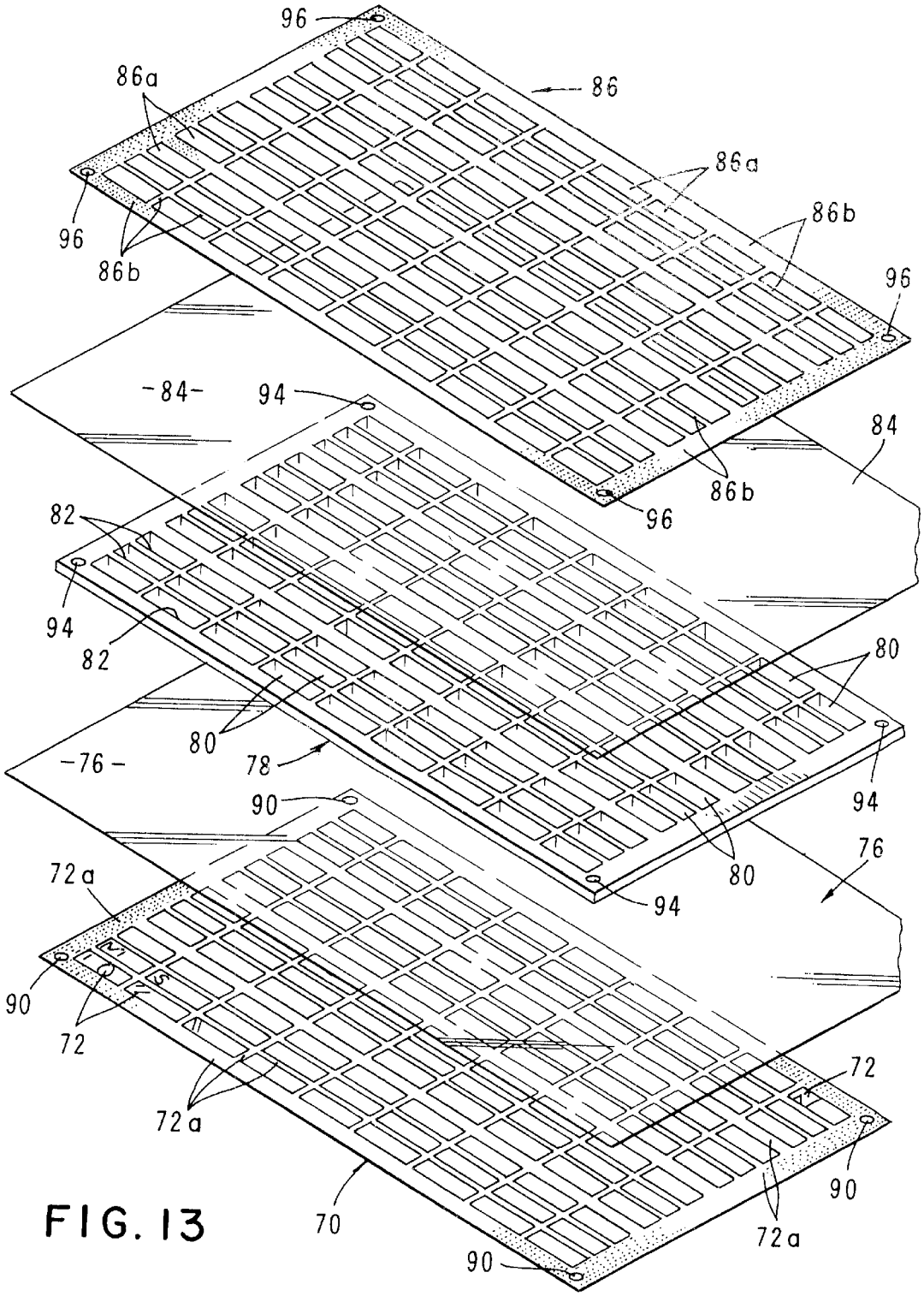
FIG. 13 is a generally perspective view illustrating various component parts used in the accomplishment of one form of the method of the invention.
Figure 16:
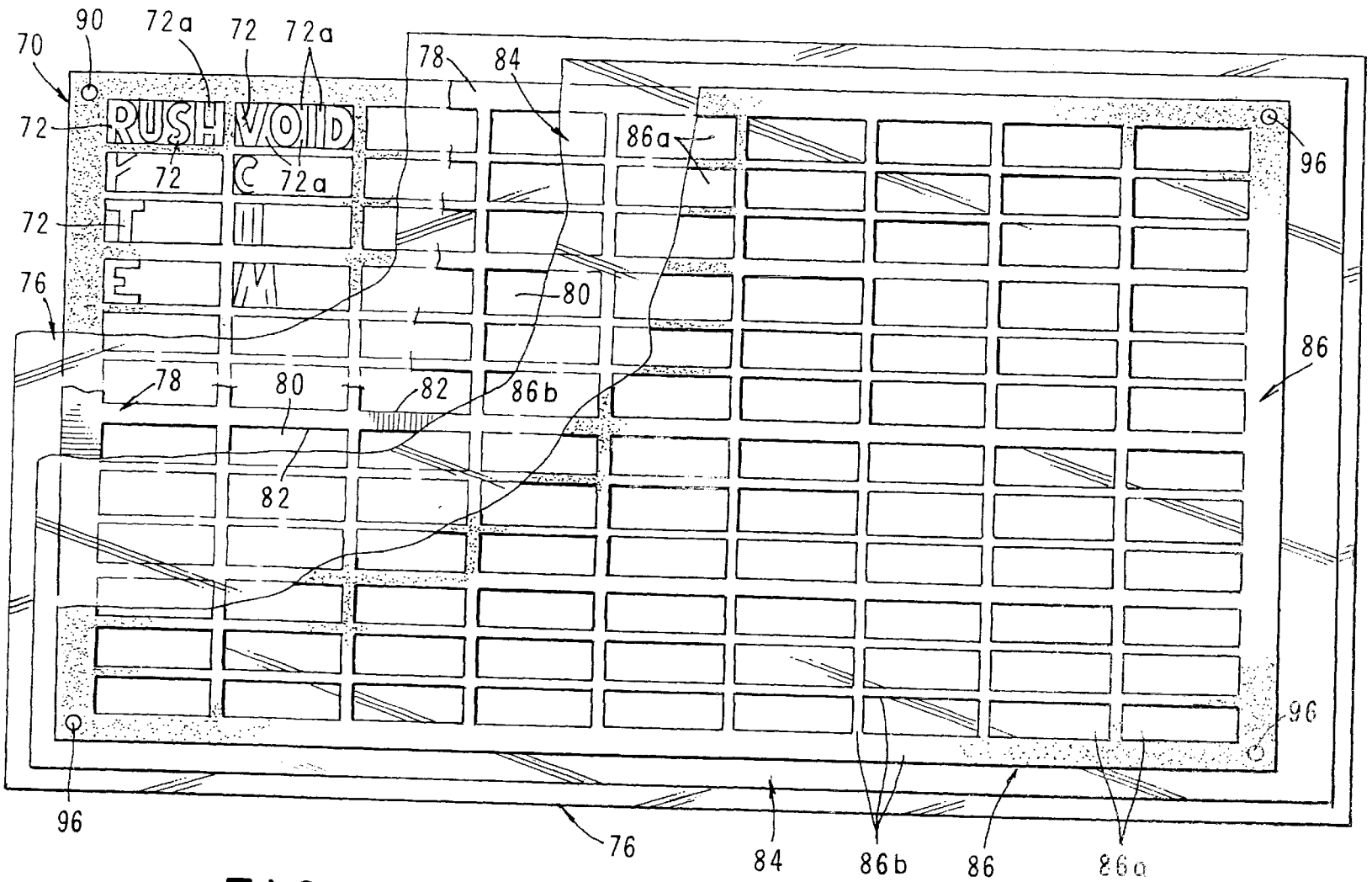
FIG. 16 is a plan view, partly broken away to better show the relationship among the components shown in FIG. 13 of the drawings

Turning next to FIGS. 13, the various components used in the accomplishment of one form of the method of the invention are there illustrated. These components include a first negative 70 having formed thereon of the various art work images 72 which are to be produced by the hand stamp on an ink receiving surface and an image border 72*a* circumscribing the images. More particularly, on first negative 70, the various art work images 72 are clear while the area 72*a* surrounding the images is opaque (FIG. 16). Another component used in the accomplishment one form of the method of the invention comprises a thin, substantially transparent protective film 76. Superimposed over protective film 76 and negative 70 is a uniquely configured grid 78 having a multiplicity of openings 80 formed therein. In a manner presently to be described, openings 80 cooperate with thin film 76 to form a plurality of top open chambers 82 (FIG. 15). After chambers 82 are filled with the liquid photopolymer, in a manner presently to be described, a second substantially transparent thin film 84 is overlayed over the filled chambers. Overlaying second thin film 80 is a second negative 86, which is used to trim each of the printing elements. More particularly, second negative 86, which is also created using the original art work, has clear areas 86*a* corresponding in size and shape to the backs of the printing elements and opaque areas 86*b* surrounding the clear areas (FIG. 16).

Figure 21:
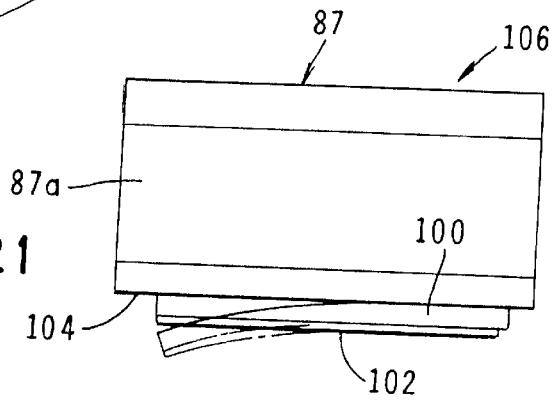
FIG. 21 is a side-elevational view of an alternate form of stamping device of the invention showing the method of removably affixing the stamp die of the invention to the smooth, mirror-like lower surface of the stamping device.
Figure 22:
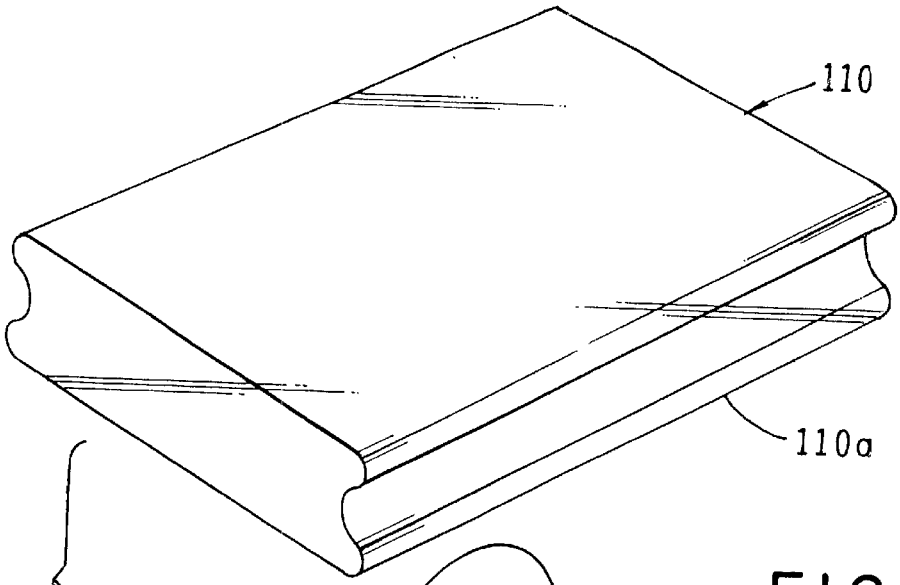
FIGS. 22, 22A, 22B and 22C when considered together illustrate an alternate form of hand stamp apparatus of the invention for producing a multicolored image on a surface using a plurality of cooperating stamping elements.
Figure 22A:
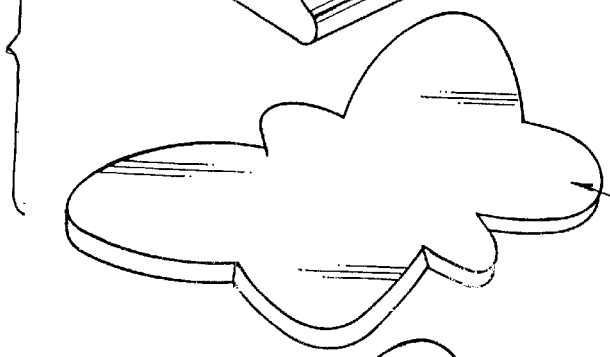
Figure 22A:
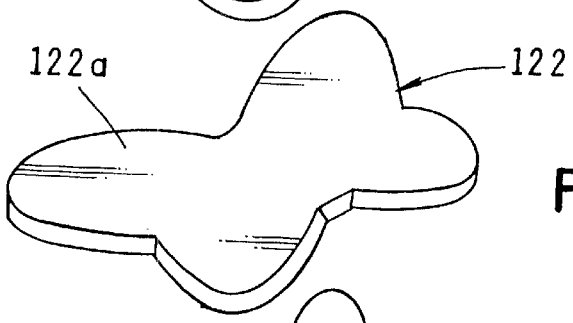
Figure 22B:
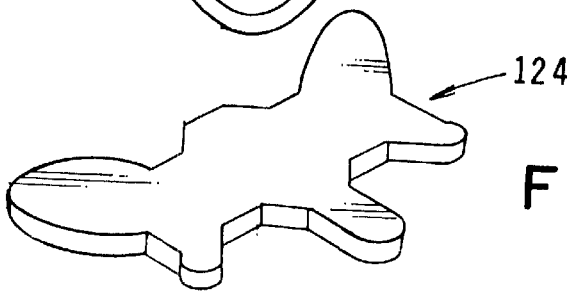
Figure 22C:
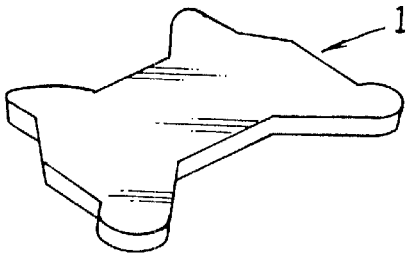

One form of the method of the invention for making the hand stamp of the invention comprises two steps, namely the step of constructing the printing element that has the image to be imprinted on the smooth surface and the step of interconnecting the printing element with the smooth surface of the body portion 87*a* of the hand stamp 87 (FIG. 21). Considering first the method of constructing the printing element, which has the image to be imprinted on the ink-receiving surface. This important method comprises the steps of first locating negative 70 on glass panel 56 of apparatus 50. For this purpose first negative 70 is provided with locating apertures 90 at each corner of the negative (FIG. 13). Apertures 90 closely receive upstanding locating pins 92 that are affixed to glass panel 56 in the manner shown in FIGS. 14 and 14A. Pins 92 extend upwardly from glass panel 56 so as to enable the precise positioning of grid 78 and second negative 86 in index with first negative 70 in the manner presently to be described and as shown in FIGS. 14 and 14A. For this purpose, grid 78 is provided is corner apertures 94 while second negative 86 is provided with corner apertures 96, which apertures closely receive locating or index pins 92.

Figure 12:
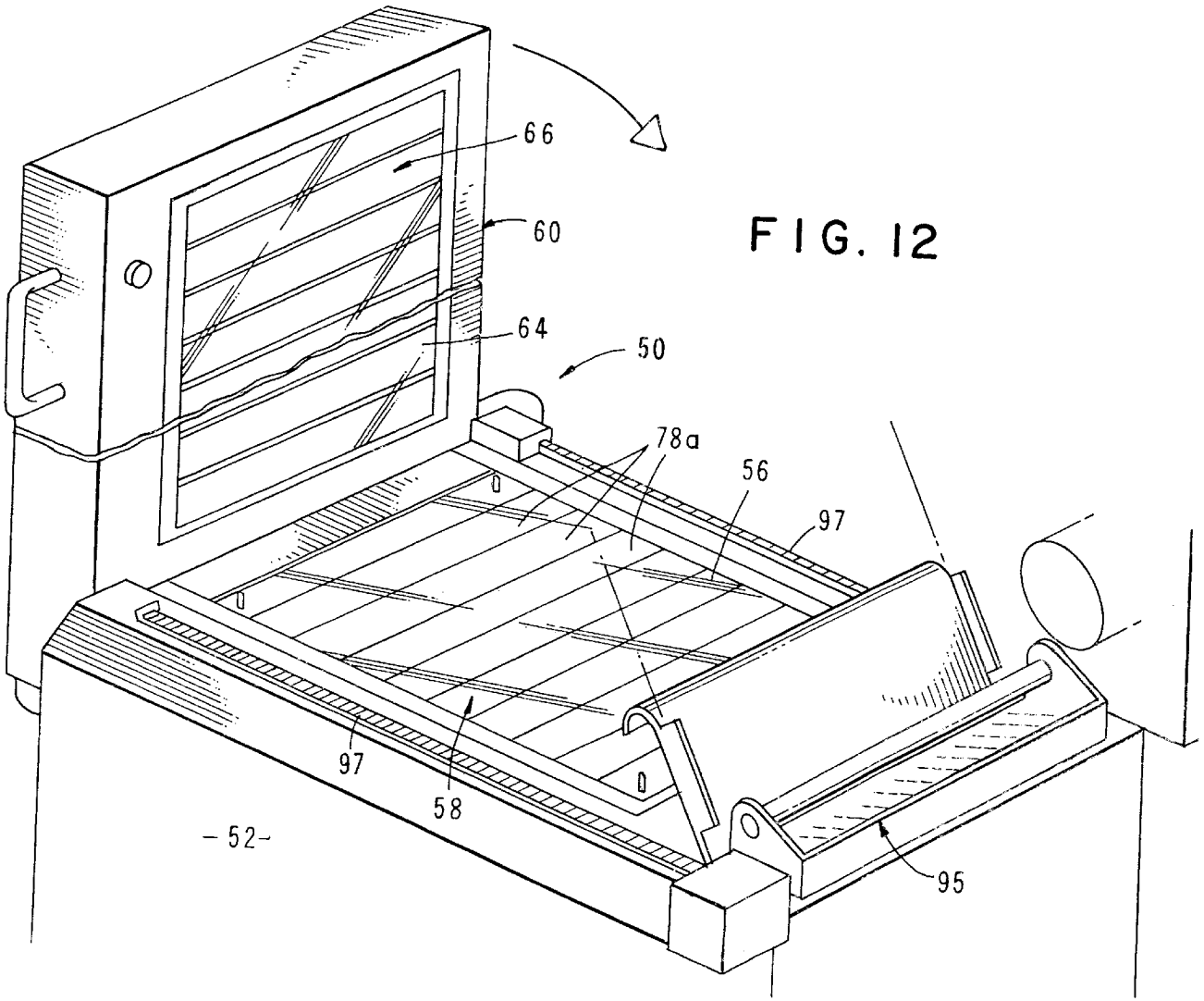
FIG. 12 is a generally perspective view of one form of the exposure and photopolymer disposition unit used in the practice of the method of the present invention.

With first negative 70 indexedly located on glass panel 56, a slight vacuum is produced beneath the negative to urge it into secure engagement with the glass panel. Next, the earlier-mentioned protective transparent film 76 is then superimposed over negative 70. This done grid 78 is superimposed over protective film 76 in the manner shown in FIGS. 14 and 14A so that it is in precise index with first negative 70. With grid 78 positioned over protective film, a plurality of top-open chambers 82 are defined, which chambers are adapted to receive the specially formulated photopolymer used in the accomplishment of the method of the invention. This specially formulated liquid photopolymer is commercially available from M & R Marking Systems, Inc. of Piscathway, N.J. and is sold under the product/chemical name Ideal i40 and Ideal i50. This material is a clear viscous liquid that will solidify or cure upon controlled exposure to ultraviolet light. While chambers 82 of grid 78 can be filled with the liquid photopolymer by any suitable means, in the method of the present invention, they are filled by a reciprocating reservoir 95 which contains the photopolymer "P" and forms a part of the processing apparatus 50 (FIG. 15). As indicated in FIG. 15, the photopolymer "P" can be controllably dispensed from reservoir 95 through an outlet 95*a* as the reservoir is rolled over the tipper surface of housing 52 along spaced-apart tracks 97 (FIG. 12).

After chambers 82 have been filled with the liquid photopolymer "P" to form a plurality of precursor printing elements, transparent film 84 is superimposed over the filled grid 78 so as to cover each of the filled chambers 82 is vile film 84 can be positioned over filled grid 78 in any suitable manner, apparatus 50 provides a mechanism 99 for emplacing the thin film over the filled grid in the manner illustrated in FIGS. 14A and 15.

With film 84, which is preferably a polyester film, positioned over filled grid 78, second negative 86 is superimposed over film 84 in the manner shown in FIGS. 14 and 14A and is precisely indexed with grid 78 and with first negative 70 by means of the indexing pins 92. More specifically, with second film 86 properly positioned over the assemblage comprising first negative 70, protective film 76, gird 78, and thin film 84, the clear areas 86*a* of negative 86 are in precise index with chambers 82 and the opaque areas 86*b* of the negative are in precise index with the image borders that circumscribe stamp element images 72.

With the components stacked in the manner described in the previous paragraph and in the manner illustrated in FIGS. 14 and 14A, cover 60 is moved from the position shown in the phantom lines in FIG. 14 to the position shown in the solid lines in FIGS. 14 and 14A. It is important to note that as cover assemblage 60 moves into position a uniform pressure is exerted on negative 86 and, in turn, on polyester film 84 causing a uniform controlled pressure to be applied to the liquid polymer contained within chambers 82. This pressure functions not only to regulate the thickness of the liquid photopolymer, but also to move polyester film 84 into positive pressural engagement with the liquid photopolymer to thereby produce a very smooth, highly unique, substantially planar shaped precursor engagement surface.

Figure 17:
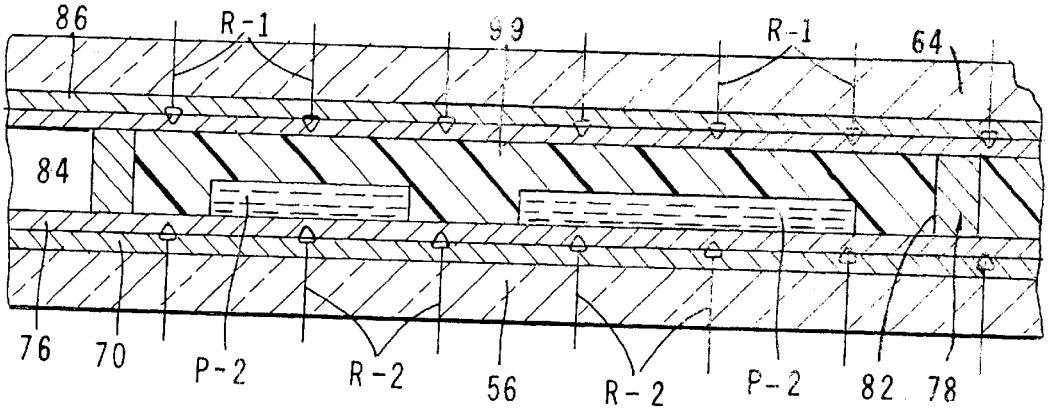
FIG. 17 is a greatly enlarged, fragmentary, cross-sectional view illustrating the exposure of the photopolymer with ultraviolet rays from the plurality of ultraviolet lamps of the exposure unit.

With the cover in position over the component assemblage in the manner shown in FIGS. 13 and 17, the ultraviolet bulbs 66*a* housed within cover assemblage 60 are energized so as to pass ultraviolet rays "R-1" through second negative 86 to expose, through clear areas 86, the precursor printing elements designated in FIG. 17 by the numeral 99. As ultraviolet rays "R-1" pass through clear areas 86*a* of negative 86, the liquid photopolymer contained within chambers 82, or precursor elements 99, will be activated and will solidify to a predetermined thickness which is dependent upon the exposure time of the photopolymer to the ultraviolet rays. As will be discussed in greater detail hereinafter, this first exposure of the photopolymer by ultraviolet lamps 66*a* forms the printing element engagement surface, or backing surface 100 of the printing element 102 that will later be removably interconnected with the smooth surface 104 of the body portion of the hand stamp 106 in the manner shown in FIG. 21.

Following exposure of the photopolymer by ultraviolet lamps 66*a* for the prescribed period of time, the previously mentioned opaque screen 61 of the exposure unit is moved from a retracted position to an extended position where it covers second negative 86 and obstructs any further ultraviolet exposure of the photopolymer from ultraviolet lamps 66*a*.

With the opaque screen suitably drawn, the next step in the method of the invention is to energize ultraviolet lamps 58*a* so as to pass ultraviolet rays "R-2" through the clear areas 72 of first negative 70 in a manner to expose the unexposed liquid photopolymer designated in FIG. 17 as "P-2". More particularly, as illustrated in FIG. 17, as the ultraviolet rays "R-2" emanating from ultraviolet lamps 58*a* pass through the clear portions 72 of first negative 70, the liquid polymer "P-2" will be activated and will solidify to form the upraised portions 203*a* of the printing element (see also FIG. 18). It is apparent that this second curing step using lamps 58*a* will create a stamp element of the character shown in FIGS. 18 and 20 that comprises the backing surface 100 and the upraised indicia portions 102*a*, which in this instance comprise the images or letters to be imprinted on the printing surface. However, during the second exposure step, it is apparent that the portions of the photopolymer that surround the upraised indicia portions will not be exposed to rays "R-2" and, therefore, will not be activated. These unexposed portions of polymer can be washed away by the washing step of the method next to be described.

Figure 18:
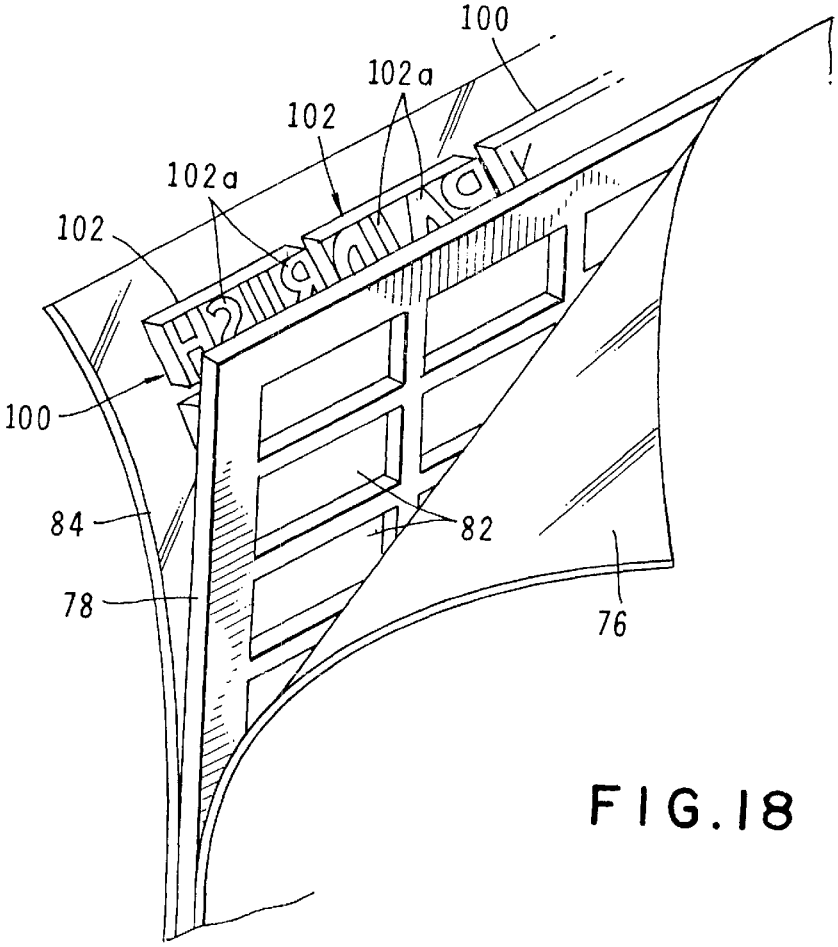
FIG. 18 is a fragmentary, generally perspective, diagrammatic view illustrating the separation of certain of the components used in the accomplishment of the method of the invention following radiation of the photopolymer in the manner shown in FIG. 17.
Figure 19:
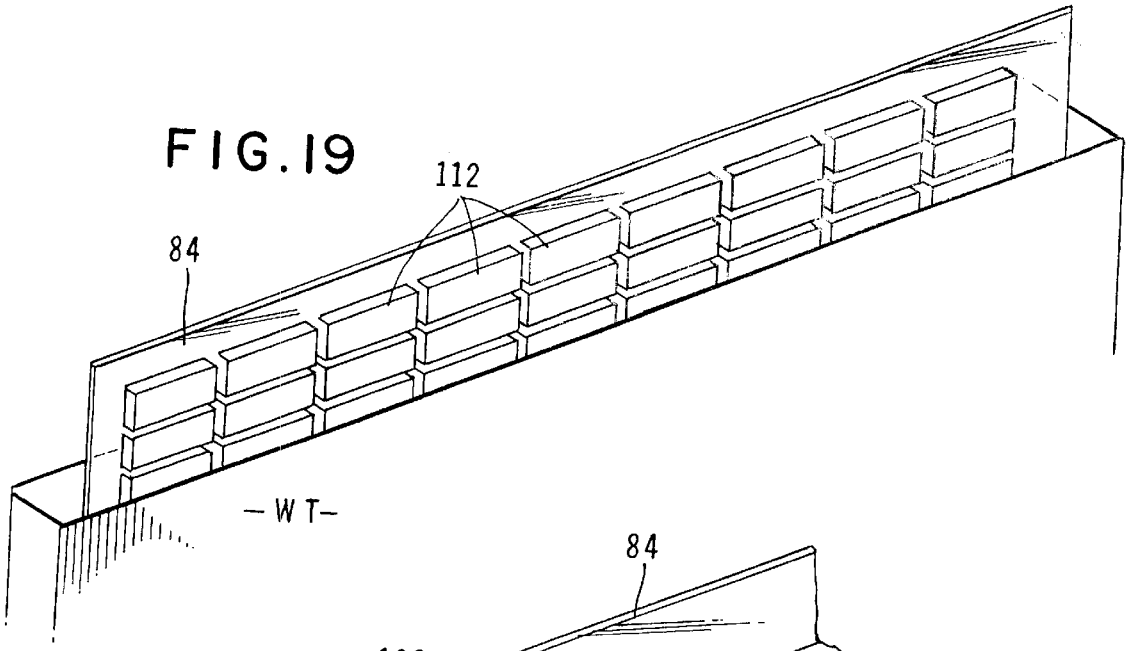
FIG. 19 is a generally perspective, diagrammatic view illustrating the washing step wherein the precursor printing elements are washed to remove unexposed photopolymer.

As illustrated in FIG. 18, following the photopolymer exposure steps, grid 78, along with the exposed photopolymer and films 76 and 84, are removed from the exposure unit. Films 76 and 84 are then stripped away from grid 78 in the manner shown in FIG. 18. As film 84 is separated from grid 78, the exposed photopolymer, which now comprises the precursor printing element, will adhere to film 84 and will cleanly separate from grid 78. The assemblage comprising film 84 and the precursor stamped elements is then submerged in a washing tank "WT" which is filled with a washing solution such as water and various chemical solutions. As the assemblage made up of film 84 and precursor stamps 102 is submerged in to tank "WT", the unexposed liquid photopolymer will wash away leaving the cleanly formed upstanding indicia 102*a* and forming the final printing element 102 having the printing element engagement surface 100 and the upstanding indicia 102*a*.

Figure 20:
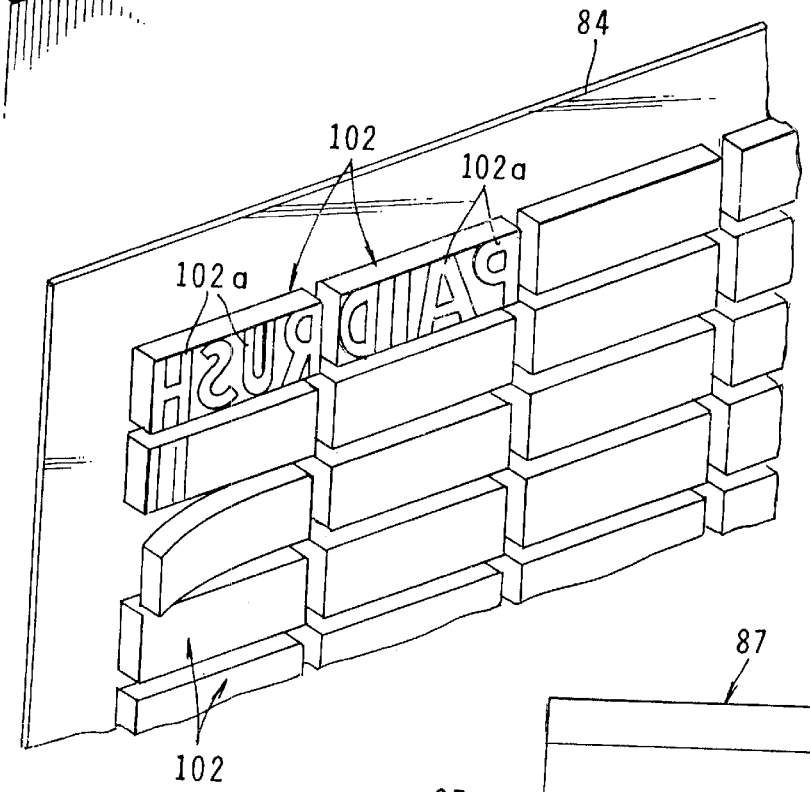
FIG. 20 is a generally perspective, fragmentary view of a portion of the printing element array following the washing step.

Following the washing step each of the plurality of printing elements 102 can be readily peeled away from thin film 84 in the manner illustrated in FIG. 20. As earlier mentioned, the novel step of pressurally engaging the unexposed liquid photopolymer with the very smooth surface of film 84 produces a highly novel gripping surface comprising a multiplicity of extremely small, microscopic suction cup like elements which enable the printing elements formed by the novel method of the invention to be removably affixed to any smooth surface such as the surface of film 84 and the smooth, microscopic surface 104 of the hand stamp device of the invention (FIG. 21). This unique aspect of the method and apparatus of the present invention, permits the formation of printing elements of the character shown in FIG. 20 wherein the backing portion of the stamp is precisely trimmed to coincide with the edges of the upright indicia 102*a*. Unlike the prior art stamping elements, which require a base flange that extends beyond the perimeter of the upstanding indicia elements to enable successful adhesive bonding of the stamping element to the hand stamp body, such extending flange is neither necessary, nor desired in the hand stamp of the present invention. This elimination of the adhesive carrying flange not only saves expensive photopolymer material, but also, due to the unique nature of the backing surface 100 of the stamp elements, no messy and expensive adhesive need be used to affix the stamp element 102 to the finger-gripping portion of the hand stamp 87. Further and of equal importance, this novel aspect of the invention permits the printing elements to be readily removed from, or adjusted relative to, any smooth surface such as smooth surface 104 of the hand stamp 87. This unique removability and adjustability feature of the present invention is nowhere found in the prior art which requires a backing flange that is affixed to the surface of the hand stamp to enable application of a bonding adhesive.

Referring next to FIGS. 22, 22A, 22B and 22C, one form of a hand stamp apparatus of the present invention for producing a composite image on a printing surface is there shown. This form of the apparatus comprises a transparent, acrylic mounting block 10 having a smooth surface 110*a* and a first, substantially transparent, base imprint stamp element 112 removably affixed to smooth surface 110*a*. As will presently be described, first stamp element 112 produces a first, or base imprint image on a selected portion of the printing surface which image comprises an outline 114 of the character shown in FIG. 25. As indicated in FIG. 25, outline 114 circumscribes a plurality of openings 116, 118 and 120 which are of different shapes and to which color is imparted by the remaining stamp elements depicted in FIGS. 22A, 22B and 22C. These stamp elements, which are designated respectively by the numerals 122, 124 and 126, are substantially transparent and, in a manner presently to be described, can be sequentially moved into index with the first image defined by the outline 114 (FIG. 25).

Referring particularly to FIGS. 23 and 24, stamp element 112 can be seen to comprise a first or upper surface 112*a* that is provided with a multiplicity of very small, almost microscopic, suction-like elements or protuberances which releasably grip smooth surface 110*a* of mounting block 110 in a manner shown in FIG. 24. As indicated in FIG. 24, stamp element 112 includes a second or lower surface 112*b* that comprises a plurality of upstanding surface engaging, rib-like protuberances 112*c*. In use, when surfaces 112*b* of protuberances 112*c* are inked through the use of a conventional ink pad, and are placed in contact with the surface to be printed, a pressure exerted on mounting block 110 will cause the outline 114 to be imprinted on the printing surface in the manner shown in FIG. 25 with the ink from the stamping element being deposited onto the surface along the outlines designated in FIG. 25 by the numeral 114.

Once the first image is imprinted onto the printing surface in the manner shown in FIG. 25, the openings 116, 118, and 120 are next imprinted with various colors in sequential fashion using printing elements 122, 124 and 126. More particularly, after the first image is formed on the surface to be imprinted, printing element 112 is removed from surface 110*a* and printing element 122 is affixed to surface 110*a* in its place through the use of the multiplicity of small, suction-like elements or protuberances formed on upper surface 112*a* of stamp element 122.

Figure 26:
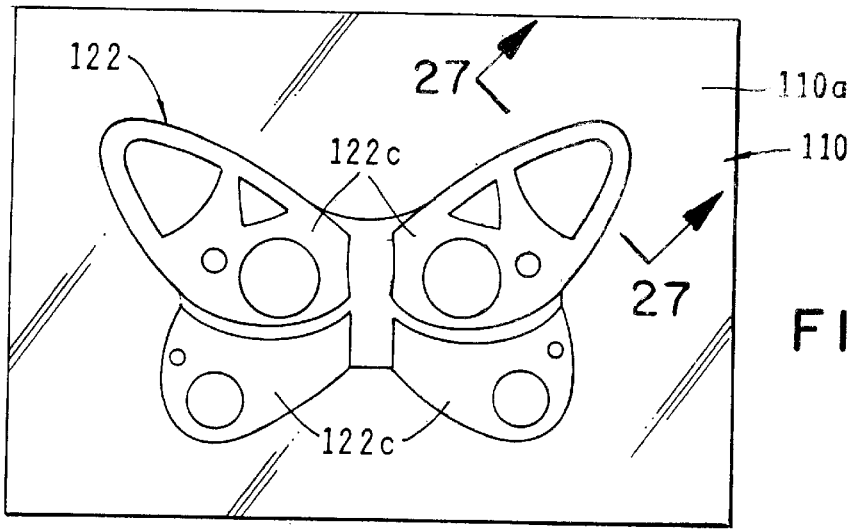
FIG. 26 is a bottom plan view showing the printing element of FIG. 22A affixed to the mounting block for producing an indexed image of another color on the printing surface.
Figure 27:
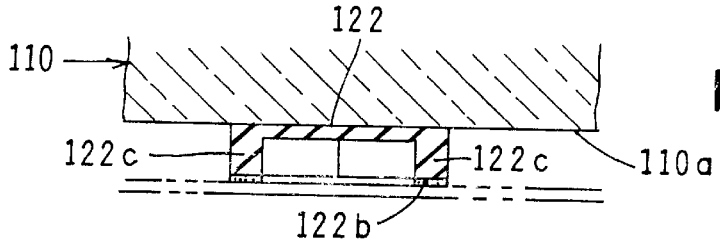
FIG. 27 is an enlarged, cross-sectional view taken along lines 27—27 of FIG. 26.

Turning next to FIGS. 26 and 27, it is to be noted that stamp element 122 has a second or lower surface 122*b* that is defined by downwardly extending, rib-like protuberances 122*c*. As indicated in FIG. 26, protuberances 122*c* have the general shape of openings 116 (FIG. 25). With this construction, when stamping element 122 is affixed to mounting block 110 in the manner shown in FIG. 26 and 27, surfaces 122*b* of protuberances 122*c* can be inked with of a first color ink by pressureally engaging surfaces 122*b* against a stamp pad having the first color, ink, as for example the color yellow. Once surfaces 122*b* have been inked, stamp element 122 can be precisely aligned with openings 116 of the first image formed on the printing surface by viewing the first imprint shown in FIG. 25 through the clear acrylic mounting block 110. When surfaces 122*b* have been precisely indexed with the openings 116 formed on the printing surface, a downward pressure exerted on the mounting block 110 will cause the colored ink to be transferred to surfaces 116 thereby precisely coloring these surfaces with the first color, such as the color yellow.

Figure 28:
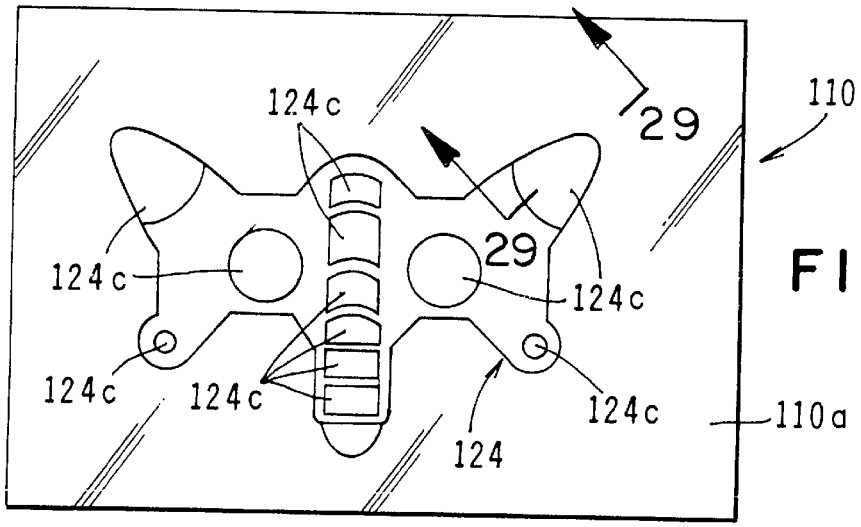
FIG. 28 is a bottom plan view showing the stamping element of FIG. 22B affixed to the mounting block for use in producing an indexed image of still another color.
Figure 29:
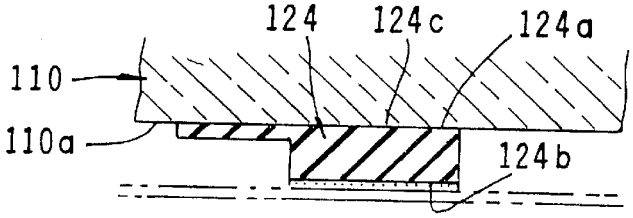
FIG. 29 is an enlarged, cross-sectional view taken along lines 29—29 of FIG. 28.

Following the coloring opening 116, stamp element 122 can be removed from surface 110*a* from the mounting block and third stamping element 124 can be affixed in its place to surface 110*a* of the mounting block in the manner shown in FIGS. 28 and 29. Stamping element 124, like stamping element 112 and 122, has a first upper surface 124*a* that includes a multiplicity of microscopic suction-cup-like elements or protuberances which releasably grip surface 110*a* of mounting block 110. Stamping element 124 also has a second or lower surface 124*b* that is defined by downwardly extending protuberances 124*c* which, as shown in FIG. 28, have the general configurations of openings 118 of the first image as shown in FIG. 25. With this construction, lower surface 124*b* of stamp element 124 can be inked using an ink pad having a third color such as, for example, the color blue. Then by indexably aligning protuberances 124*c* with opening 118 of the first image, the second color, or the color blue, can be imprinted onto the areas of openings 118 to form a composite wherein areas 116 are of a first color, such as the color yellow, and areas 118 are of a second color, such as the color blue. Once again, because of the unique transparent character of mounting block 110 and the substantial transparency of printing element 124, surfaces 124*b* of protuberances 124*c* can be precisely aligned with openings 118 to accurately color these areas with the second color.

Figure 30:
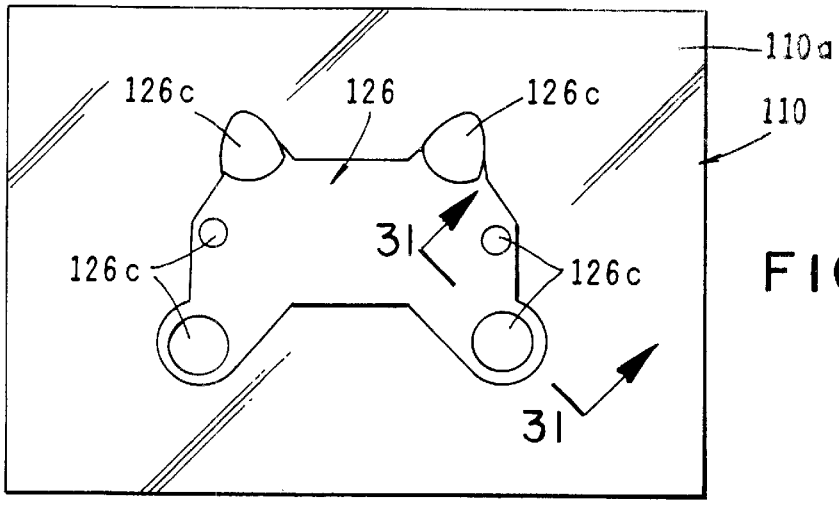
FIG. 30 is a bottom plan view showing the stamping element of FIG. 22C affixed to the mounting block for producing an indexed image of vet another color.
Figure 31:
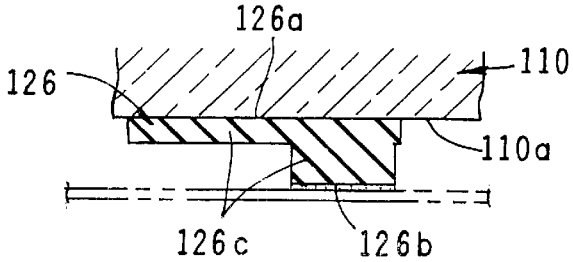
FIG. 31 is an enlarged, cross-sectional view taken along lines 31'31 of FIG. 30.
Figure 32:
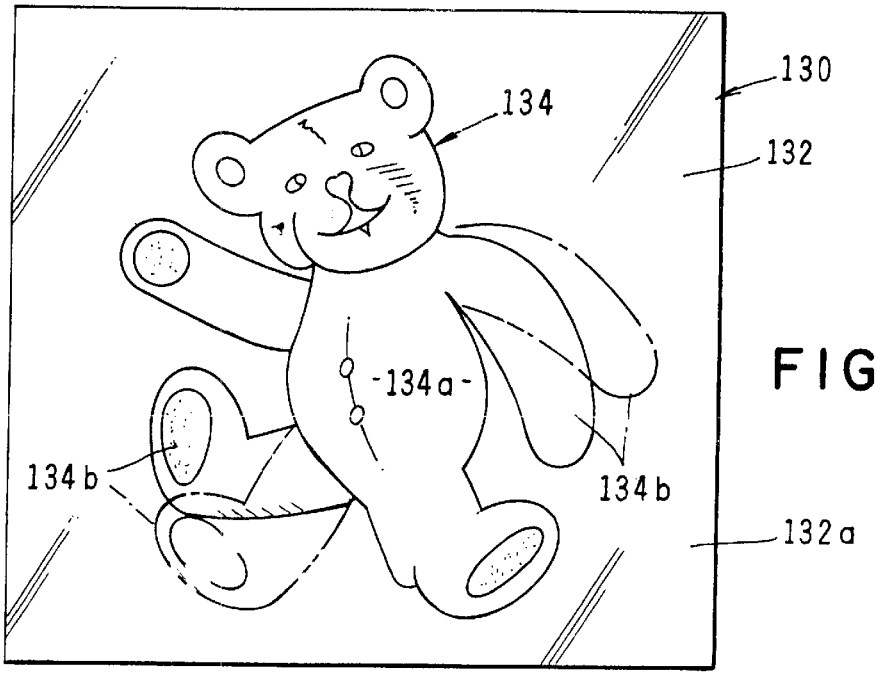
FIG. 32 is a bottom plan view of yet another form of the printing apparatus of the invention wherein the stamp element includes a body portion and first and second segments adjustably connected to the body portion, FIGS. 33, 34 and 35, when considered together, show a plurality of stamping elements for producing various composite images on a printing surface.

Once this second coloring step has been completed, stamp element 124 can be removed from mounting block 110 and a fourth stamp element can be affixed in it place in a manner illustrated in FIGS. 30 and 31. As shown in FIG. 31, printing element 126 also includes a first surface 126*a* which is provided with a multiplicity of microscopic, suction-cup-like protuberances which securely engage smooth surface 110*a* of mounting block 110 in the manner shown in FIG. 31. Stamping element 126 also includes a second lower surface 126*b* which is defined by downwardly extending protuberances 126*c*. As indicated in FIG. 30, protuberances 126*c* are of the general configuration of openings 120 of the first image that was imprinted on the printing surface. As before, using an appropriate ink pad, surfaces 126*b* are covered with ink of a third color, such as the color red. Once surface 126 is covered with the red ink, printing element 126 can be precisely, indexably aligned with the first image imprinted on the printing surface so that protuberances 126*c* are precisely aligned with openings 120 of the first image shown in FIG. 25. Once again this precise indexing of printing element 126 is made possible because of the substantial transparency of both the mounting block 110 and the printing element 126. Once the areas 120 have been imprinted with a third color such as the color red, stamp element 116 can be readily removed from the surface 10*a* of mounting block 110. Preferably, the inks used in the imprinting process are of a character that will wash away from the inking surfaces of printing elements 112, 122, 124 and 126 after the passage of a short time interval. This enables reuse of the apparatus to print composite images of the same or a different color Turning next to FIGS. 32, all alternate form of the hand stamp apparatus of the invention is there shown and generally designated by the numeral 130. Stamping apparatus 130 includes a substantially transparent mounting block 132 having a smooth surface 132*a* and a stamp element 134 can be removably affixed to smooth surface 132*a* for producing an image on a surface to be imprinted. In this latest form of the invention, stamp element 134 uniquely includes a body portion 134*a* and a plurality of arm and leg-like segments 134*b* that are movably interconnected with body portion 134*a* for selective movement from the first position shown in the solid lines of FIG. 32 to a second position shown by the phantom lines in FIG. 32. More particularly, because stamping element 134 is uniquely provided with a first surface having a multiplicity of very small suction-cup-like protuberances, body portion 134*a* as well as segments 134*b* can readily be releasably affixed to smooth surface 132*a* of mounting block 132. However, in this latest form of the invention, once the printing element 134 has been affixed to the mounting block in the manner shown in FIG. 32, one or more of the segments 134*a* and 134*b* can be lifted from surface 132*a* and adjusted relative to body portion 134*a* so as to create a second image different from the first image produced by the stamp element in its first position. In this way, a number of images can be sequentially produced with each image having the arm and leg-like portions 134*b* in a different orientation with respect to body portion 134*a* of the hand stamp. This is not possible with conventional prior art constructions which embody a semi-rigid backing that is not bendable from side to side.

Figure 36:
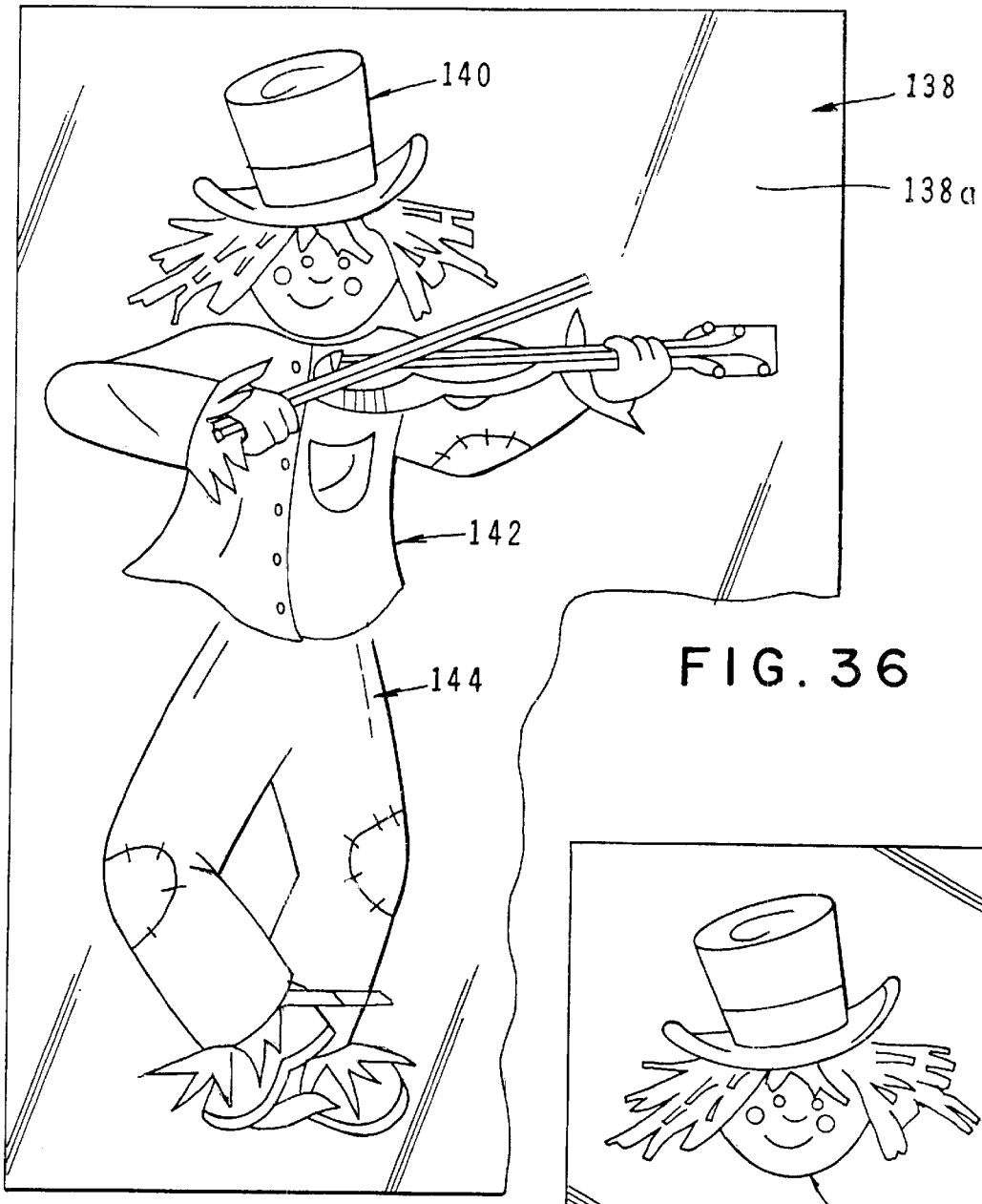
FIG. 36 is a bottom plan view illustrating a selected one of the stamping element of FIGS. 33, 34, and 35 removably connected to a mounting block.
Figure 37:
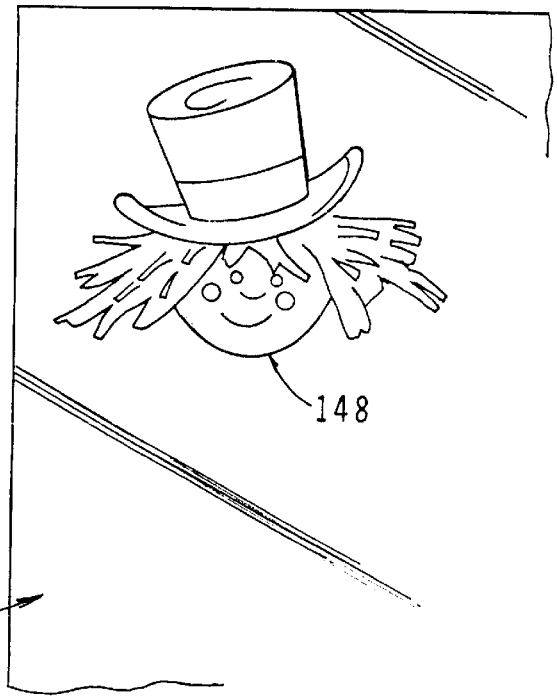
FIG. 37 is a bottom plan view illustrating a selected three of the stamping elements of FIGS. 33, 34, and 35 removably interconnected to a mounting block.

Turning next to FIGS. 33 through 37, still another form of hand stamp apparatus of the present invention is there illustrated. This apparatus, like the earlier described apparatus, includes a substantially transparent acrylic mounting block 138 having a smooth surface 138*a* (FIG. 37). This latest form of the invention is specifically designed for producing a composite image on a surface to be imprinted and comprises a first substantially transparent stamp element 140 that can be removably affixed to the mounting block, a second substantially transparent stamp element 142 that can be removably affixed to mounting block 138, and a third stamping element 144 that can be removably affixed to mounting block 138. As illustrated in FIG. 36, the apparatus of this latest form of the invention can be used to print a single image, such as that shown in FIG. 36 and designated by the numeral 148, or alternatively, the apparatus can be used to produce a composite image of the character shown in FIG. 37 wherein images corresponding to stamping elements 140, 142, and 144 can be imprinted on a printing surface in the composite arrangement illustrated in FIG. 37.

Figure 33:
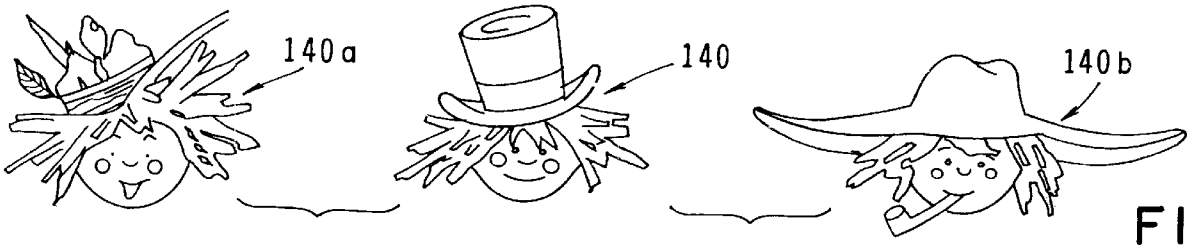
Figure 34:
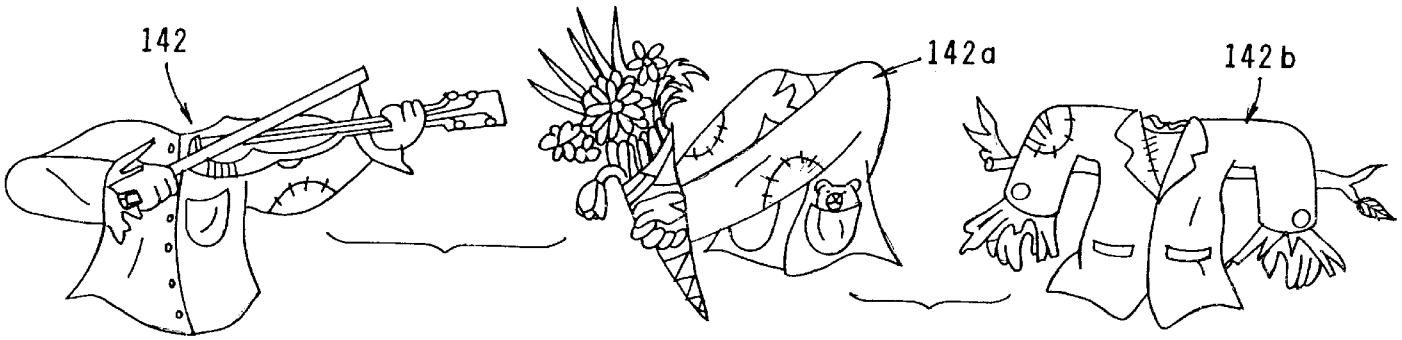
Figure 35:
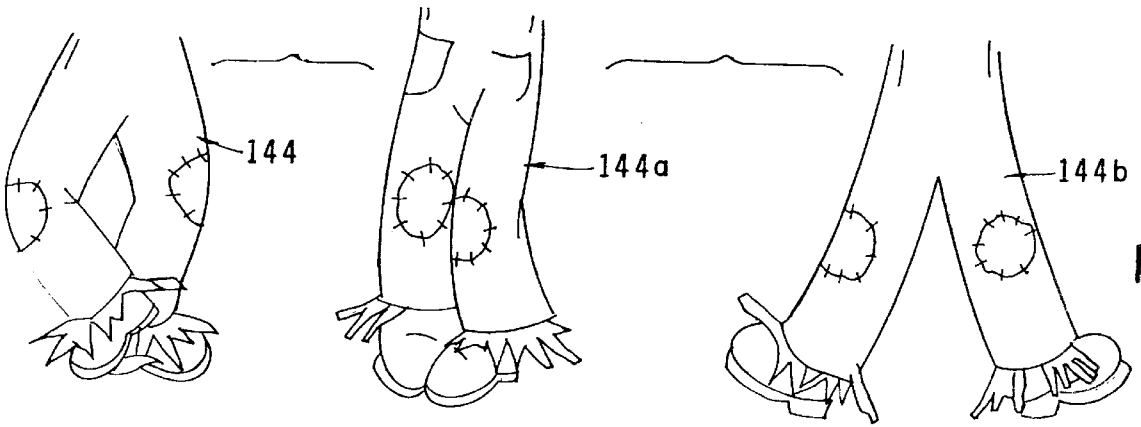

As illustrated in FIG. 33, during the production of other composite images, stamping element 140 can be replaced by either of the stamping elements 140*a* and 140*b* which are here shown as fanciful head portions of the composite shown in FIG. 37. Similarly, alternate forms of stamping element 142 of the character shown in FIG. 34 can be provided. These elements are designated in FIG. 34 as 142*a* and 142*b*. During the printing step, any one of the elements 142, 142*a* and 142*b* can be used to form a composite stamping element of the general character shown in FIG. 37. In similar fashion, counterpart stamping elements to elements 144 can be provided in the form of the stamping elements designated in FIG. 35 by the numeral 144*a* and 144*b*. A selected one of the elements 144, 144*a* and 144*b* can be affixed to the mounting block 138 along with a selected one of stamping elements 140, 140*a*, 140*b*, 142, 142*a*, and 142*b* to provide alternate composite images of the general character shown in FIG. 37. Because of the transparent mounting block 138 and the substantially transparent, readily removable printing elements, each part of the composite image of FIG. 37 can be precisely positioned on the printing surface relative to the other parts of the image.

Figure 38:
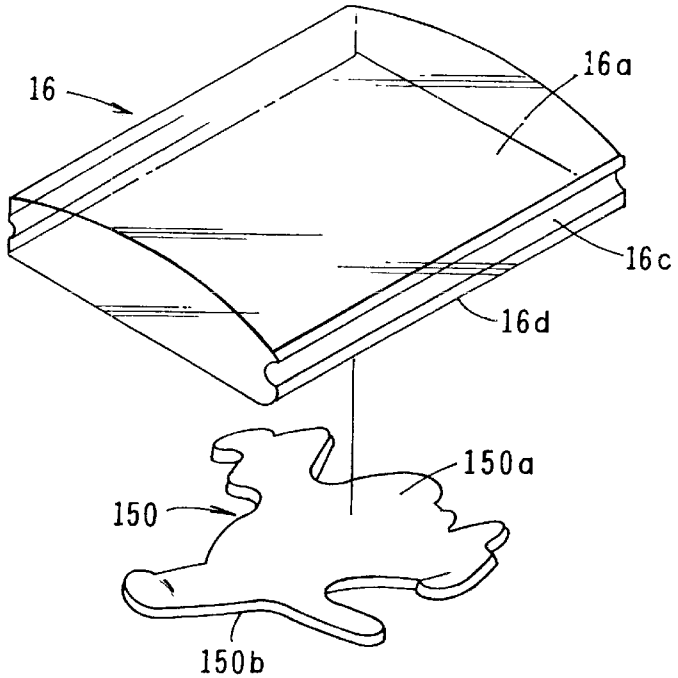
FIG. 38 is a generally perspective exploded view of a form of the invention which is somewhat similar to that shown in FIG. 1 and earlier described herein.
Figure 39:
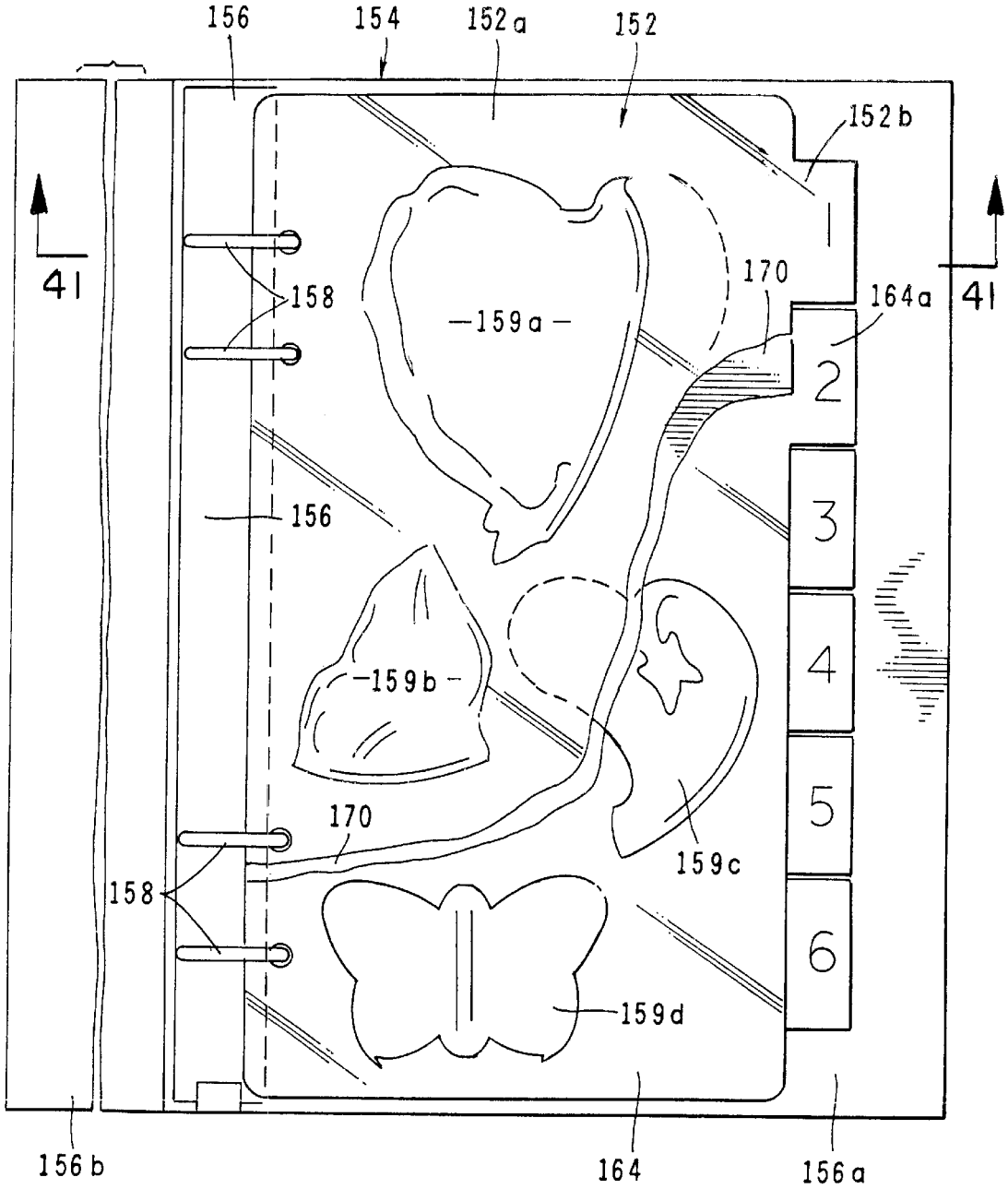
FIG. 39 is a plan view of one form of the storage device of the invention for storing and transporting the viscoelastic printing elements.
Figure 40:
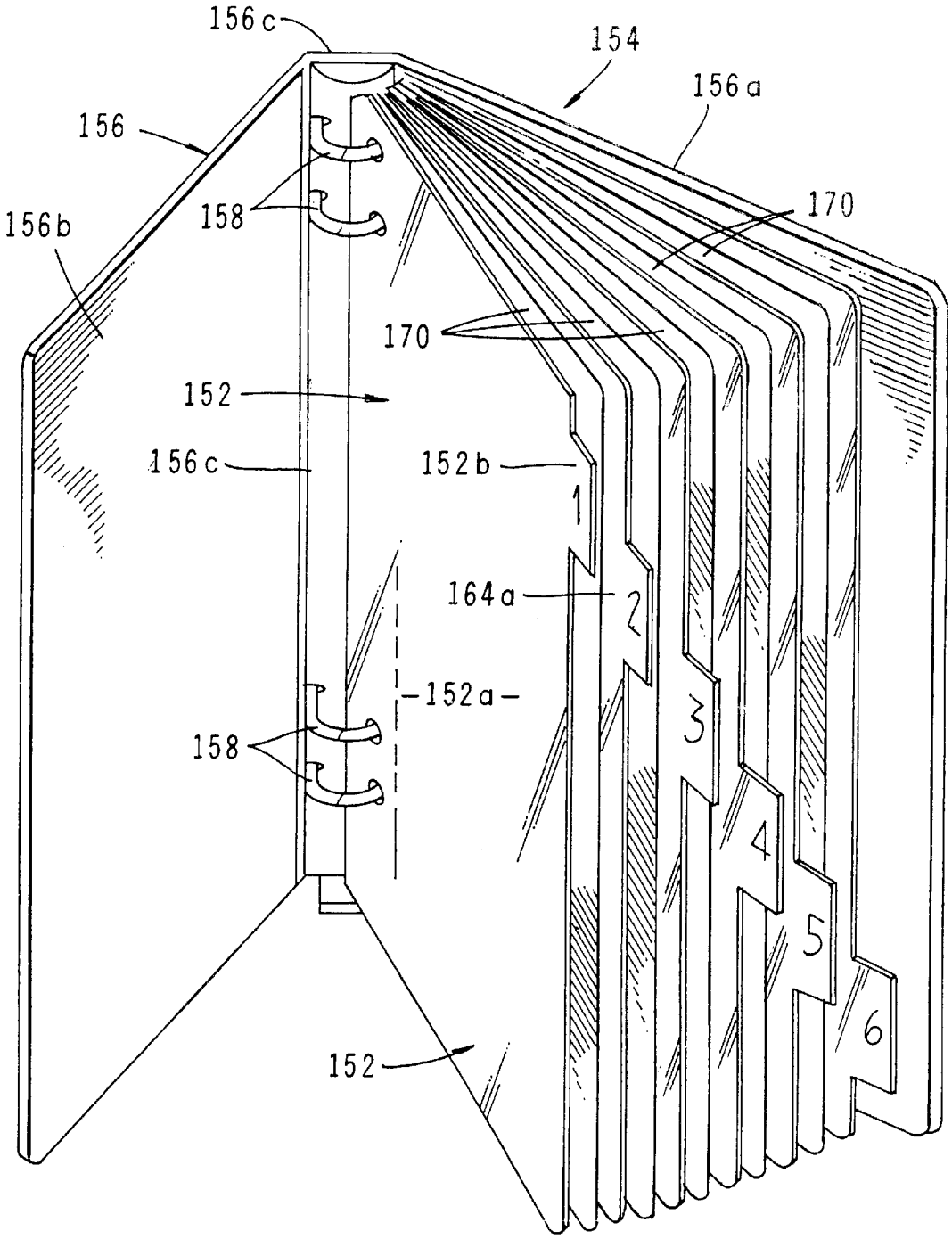
FIG. 40 is a generally perspective view of the storage device shown in FIG. 39.

Referring next to FIGS. 38 through 41, another form of apparatus of the invention is there shown. This form of the invention comprises a novel storage device for storing printing elements of the character produced in accordance with the method of the invention. Printing element 150, shown in FIG. 38, is removably affixed to bottom surface 16*b* of mounting block 16 which is of identical construction to that previously described and illustrated in FIGS. 1 and 2. Printing element 50 is resiliently deformable and includes a first side 150*a* and a second side 150*b* that is provided with upstanding ink receiving portions which define the details of the stamped impression. Side 150*a* is of a character produced in accordance with the method of the invention from a viscoelastic photo polymer and is provided with a multiplicity of small suction cup-like protuberances which function to removably connect the printing element to the smooth surfaces of block 16. As previously described, side 150*a* can be removably affixed to either of the smooth surfaces 16*a* or 16*b* of mounting block 16. Uniquely, stamping element 150 can also be removably affixed to thin film mounting sheets 152 which form a part of the storage device of the invention which is generally designated in FIG. 40 by the numeral 154. As shown in FIG. 40, storage device 154 comprises a conventional type of loose-leaf binder 156 having a back 156*a*, a cover 156*b* and a back 156*c* to which a plurality of spaced-apart split connector rings 158 are connected. Each of the mounting sheets, such as sheet 152, is apertured so that it can be slipped over rings 158 when the rings are moved into their open position. When the rings are in the closed position shown in FIG. 40, the display sheets are secured within the binder notebook 156 and can be pivoted about rings 158 in the conventional manner of a loose leaf notebook.

Importantly, each of the mounting sheets includes a smooth mounting surf face such as surface 152*a* of sheet 152. Smooth surface 152*a* is of a character similar to smooth surfaces 16*a* and 16*b* of mounting block 16 so that the viscoelastic printing elements of the invention can be removably affixed to the mounting sheets by pressing the gripping surfaces, such as surface 150*a*, of the stamping elements into engagement with the smooth surface 152*a* in the manner illustrated in FIGS. 39 and 41. As indicated in FIG. 39, several stamping elements, such as elements 159*a*, 159*b*, 159*c* and 159*d* can be removably affixed to sheet 152.

Figure 41:
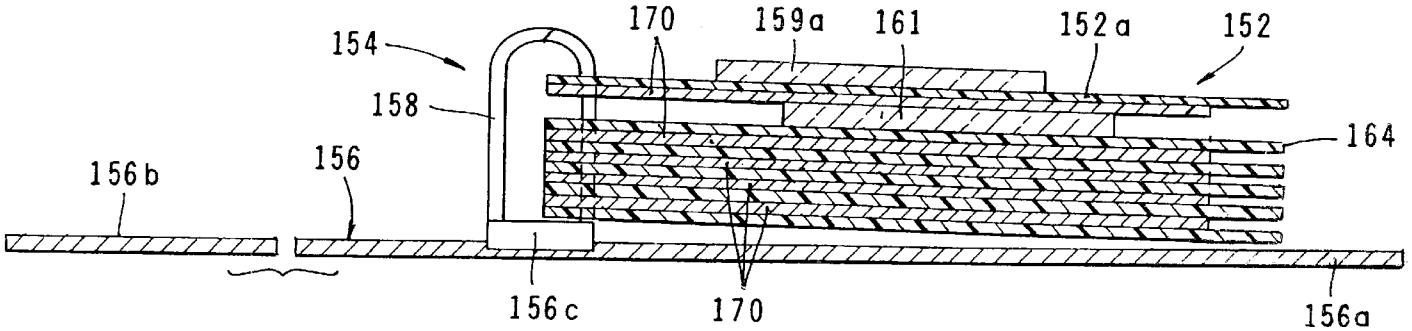
FIG. 41 is a cross-sectional view taken along lines 41—41 of FIG. 39.

As shown in FIG. 40, mounting sheet 152 includes an index element 152*b* which extends outwardly from the outboard edge of the sheet so as to function as an identifying tab to identify the stamping elements that are carried by mounting sheet 152. By way of example, as shown in FIG. 41, stamping element 159*a* is affixed to the smooth surface 152*a* of mounting sheet 152 with the gripping surface thereof in gripping contact with surface 152*a* of mounting sheet 152. In similar fashion, a second printing element designated in FIG. 41 by the numeral 161 can be mounted on a second mounting sheet 164 that is carried within notebook 156 in the manner shown in FIGS. 40 and 41. As was the case with sheet 152, mounting sheet 164 is provided with an index tab 164*a* that can be used to identify the printing elements carried on mounting sheet 164. In similar fashion a plurality of mounting sheets such as those illustrated in FIG. 40 can be carried in notebook 156 and can be provided with indexing tabs identified in FIG. 40 by the numerals 3, 4, 5, and 6. In use, these mounting sheets, like sheets 152 and 164 can carry one or more of the imprinting elements produced in accordance with the method of the invention.

The thin film mounting sheets, which are releasably carried within notebook 156, can be constructed from cast coated paper or cardboard. However, the sheets are preferably transparent and are constructed from of a variety of plastic materials such as polypropolene film, mylar film and similar materials. If desired, spacer sheets, Such as paper sheets, 170 can be disposed intermediate the mounting sheets.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. A method of making a hand stamp having a body portion having a smooth surface comprising the steps of:

(a) constructing a printing element having an image thereon comprising the steps of:

(i) superimposing a grid over a first negative having formed thereon the negative of the image to be produced and an image border circumscribing the image said grid having walls defining at least one opening, and cooperating with said first negative to form a first chamber;

(ii) filling said first chamber with a photopolymer to form a precursor printing element having a first and second surface;

(iii) overlaying a transparent film over said filled grid to form a precursor engagement surface on said photopolymer;

(iv) superimposing over said transparent film a second negative having at least one clear area in index with said image of said first negative and an opaque area surrounding said clear opening;

(v) passing rays of light through said second negative to expose said precursor engagement surface of said photopolymer to light to form a printing element engagement surface;

(vi) passing rays of light through said first negative to expose said first surface of said precursor printing element to light to form a printing element having an image; and (vii) removing said printing element from said grid; and (b) urging said printing element engagement surface into pressural engagement with the smooth surface of said body portion of the hand stamp.

2. The method as defined in claim 1 including the further step of urging said transparent film into pressural engagement with said precursor engagement surface.

3. The method as defined in claim 1 in which said first negative has a plurality of images formed thereon and an image border circumscribing each said image.

4. The method as defined in claim 3 in which said grid comprises walls defining a plurality of openings and cooperates with said first negative to form a plurality of chambers.

5. The method as defined in claim 4 in which said second negative has a plurality of clear openings circumscribed by opaque areas.

6. A method of making a hand stamp having a body portion having a smooth surface comprising the steps of:

(a) constructing a printing element having an image thereon comprising the steps of:

(i) superimposing a transparent, protective film over a first negative having formed thereon the image to be produced and an image border circumscribing the image;

(ii) superimposing over said protective film a grid having walls defining at least one opening, and cooperating with said protective film to form a first chamber;

(iii) filling said first chamber with a photopolymer to form a precursor printing element having first and second surfaces;

(iv) overlaying a transparent film over said filled grid;

(v) superimposing over said transparent film a second negative having at least one clear area in index with said image of said first negative and an opaque area surrounding said clear opening;

(vi) exerting a pressure upon said second negative and said second transparent film to exert a pressure on said second surface of said precursor printing element to form a substantially planar precursor engagement surface;

(vii) passing ultraviolet rays of light through said second negative to expose said precursor engagement surface to said ultraviolet rays of light to form an engagement surface;

(viii) passing rays of ultraviolet light through said first negative and said first transparent film to expose said first surface of said precursor printing element to said rays of ultraviolet light to form a precursor printing element; and (ix) removing said precursor printing element from said grid; and (x) removing from said precursor printing element unexposed polymers to form a printing element having a printing element engagement surface; and (b) urging said printing element engagement surface of said printing element into pressural engagement with the smooth surface of said body portion of the hand stamp.

7. The method as defined in claim 6 including the further step of washing said precursor printing element with water prior to its removal from said grid.

* * * * *